US012313056B2

(12) United States Patent
Gharakhanian et al.

(10) Patent No.: US 12,313,056 B2
(45) Date of Patent: May 27, 2025

(54) PUMPING SYSTEM

(71) Applicants: Razmik David Gharakhanian, Glendale, CA (US); Levik Kodaverdian, Glendale, CA (US); Mark S. Walker, Jr., Apple Valley, CA (US)

(72) Inventors: Razmik David Gharakhanian, Glendale, CA (US); Levik Kodaverdian, Glendale, CA (US); Mark S. Walker, Jr., Apple Valley, CA (US)

( * ) Notice: Subject to any disclaimer, the term of this patent is extended or adjusted under 35 U.S.C. 154(b) by 0 days.

(21) Appl. No.: 18/146,587

(22) Filed: Dec. 27, 2022

(65) Prior Publication Data

US 2024/0209848 A1 Jun. 27, 2024

(51) Int. Cl.

| | |
|---|---|
| ***F04B 49/04*** | (2006.01) |
| ***F04B 17/06*** | (2006.01) |
| ***F04B 23/00*** | (2006.01) |
| ***F04B 53/00*** | (2006.01) |
| ***F04F 1/10*** | (2006.01) |
| ***F04F 5/10*** | (2006.01) |

(52) U.S. Cl.

CPC ..... *F04B 49/04* (2013.01); *F04B 23/00* (2013.01); *F04B 53/005* (2013.01); *F04F 5/10* (2013.01); *F04B 17/06* (2013.01); *F04F 1/10* (2013.01)

(58) Field of Classification Search

None

See application file for complete search history.

(56) References Cited

U.S. PATENT DOCUMENTS 1,611,478 A * 12/1926 Massey ..... E02F 7/065 209/250
2,919,027 A * 12/1959 Blumenfeld ..... E04H 4/1654 210/167.16

(Continued)

FOREIGN PATENT DOCUMENTS

| | | |
|---|---|---|
| EP | 1920698 A1 | 5/2008 |
| WO | WO 95/18685 A1 | 7/1995 |

OTHER PUBLICATIONS

Matala Power-Cyclone Pond Vacuum with Dual Pump System by Matala product information, Accessed on Jan. 2, 2019.

*Primary Examiner* — Dominick L Plakkoottam
*Assistant Examiner* — Geoffrey S Lee
(74) *Attorney, Agent, or Firm* — Knobbe, Martens, Olson & Bear, LLP

(57) ABSTRACT

A buoy assembly for use with a pumping system to pump liquid and debris from a flooded shaft or well or any such structure with appreciable depth is provided. The buoy assembly includes a proximal tube that can couple to an end of a hose coupled at an opposite end to the pumping system. A buoy is coupled to the proximal tube that provides the buoy assembly with buoyancy that allows the buoy assembly to float on the liquid in the shaft. The buoy can have one or more aeration ports that can be selectively opened (by removing a plug therefrom) to allow airflow therethrough into the buoy. The buoy assembly also has an adapter socket with feet that define vents therebetween to allow passage of debris via the vents into the buoy. Flow of air into the buoy via the aeration ports facilitates lift of liquid and debris through the conduit during a pumping operation.

18 Claims, 20 Drawing Sheets

(56) References Cited

U.S. PATENT DOCUMENTS 2,989,185 A * 6/1961 Lombardi ..... E04H 4/1263 210/167.2
3,253,547 A 5/1966 Weis
3,343,199 A * 9/1967 Nolte ..... A47L 11/4088 15/328
3,384,914 A * 5/1968 Wilhelmsen ..... E04H 4/1654 15/1.7
3,481,470 A * 12/1969 Valois ..... B01D 29/41 210/167.14
3,665,942 A * 5/1972 Moore ..... E04H 4/1681 440/38
3,755,843 A * 9/1973 Goertzen, III ..... E04H 4/1618 15/350
3,796,373 A * 3/1974 Moore ..... E04H 4/1681 134/167 R
3,883,269 A 5/1975 Wolff
3,883,366 A * 5/1975 Blumenfeld ..... E04H 4/1681 134/52
4,040,864 A * 8/1977 Steeves ..... E04H 4/1681 210/167.17
4,064,586 A * 12/1977 Caron ..... E04H 4/1654 210/167.16
4,080,104 A * 3/1978 Brown, Jr. ..... A47L 7/0028 417/40
4,087,286 A * 5/1978 Sexton ..... E04H 4/1681 134/167 R
4,179,768 A 12/1979 Sawyer
4,352,251 A * 10/1982 Sloan ..... E02F 3/02 37/333
4,378,611 A * 4/1983 Ninehouser ..... A47L 11/4083 417/40
4,756,671 A * 7/1988 Grimes ..... F04F 1/18 43/4.5
4,801,376 A * 1/1989 Kulitz ..... E04H 4/1636 210/123
4,807,373 A * 2/1989 Sloan ..... E02F 3/8891 210/241
4,841,595 A 6/1989 Wiese
4,854,058 A * 8/1989 Sloan ..... E02F 3/88 210/241
4,957,622 A * 9/1990 Mims ..... E02F 3/885 37/313
4,988,437 A * 1/1991 Gefter ..... B01D 35/30 210/453
4,991,321 A * 2/1991 Artzberger ..... E02F 3/88 37/309
5,129,167 A * 7/1992 Nakahara ..... E02F 3/925 37/318
5,143,605 A * 9/1992 Masciarelli ..... E04H 4/1263 210/242.1
5,295,317 A * 3/1994 Perrott ..... E02F 3/925 37/348
5,338,446 A * 8/1994 Schuman ..... E04H 4/1645 210/453
5,349,722 A 9/1994 Chayer
5,525,042 A 6/1996 Batten
5,618,410 A 4/1997 Wallace et al.
5,647,691 A * 7/1997 Wirth ..... E02F 1/00 405/74
5,749,711 A 5/1998 Park
6,086,759 A * 7/2000 Bisseker ..... B01D 29/27 210/167.19
6,139,730 A * 10/2000 Buehler ..... B01D 17/0208 210/167.01
6,200,104 B1 3/2001 Park
6,251,286 B1 * 6/2001 Gore ..... B01D 17/0214 210/776
6,755,623 B2 * 6/2004 Thiriez ..... A61B 5/15105 210/219
6,837,174 B1 1/2005 Baurley
7,334,358 B1 * 2/2008 Whyte ..... E02F 3/8891 37/324
7,875,123 B2 * 1/2011 Crawford, III ..... B08B 9/0856 210/747.2
7,942,649 B2 5/2011 Lesther
8,122,618 B2 * 2/2012 Van Rompay ..... E02F 3/885 37/317
8,146,201 B2 4/2012 Conrad
8,221,031 B2 * 7/2012 Detering ..... E02B 3/023 405/74
8,641,386 B2 2/2014 Szuster
8,782,852 B1 7/2014 Henderson
9,765,769 B2 9/2017 Cox
9,919,249 B2 * 3/2018 Buckner ..... C02F 1/001
10,092,867 B2 * 10/2018 Borg ..... B01D 35/28
10,111,562 B2 10/2018 Fording et al.
10,557,480 B1 2/2020 Gharakhanian et al.
2002/0152578 A1 10/2002 Lee
2002/0166804 A1 * 11/2002 Henkin ..... E04H 4/1654 210/167.16
2010/0011521 A1 * 1/2010 Collins ..... E04H 4/1681 15/1.7
2012/0020734 A1 * 1/2012 Ross ..... E03B 3/04 405/80
2015/0247330 A1 * 9/2015 Norberto, III ..... E04H 4/1263 210/167.18
2017/0150646 A1 5/2017 Verronen
2018/0229160 A1 * 8/2018 Witelson ..... B01D 29/66
2019/0310664 A1 * 10/2019 Bullard, IV ..... G05D 9/02

* cited by examiner

PUMPING SYSTEM

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57 and should be considered a part of this specification.

BACKGROUND

Field

This invention relates broadly to pumping systems for siphoning material having one or both of fluid and solid (e.g., gases, rainwater, mud, silt, waste, and the like) from one location and pumping the siphoned material to a remote location, and more particularly to pumping systems with a buoy assembly with aeration ports that can be lowered to the flooded area to siphon water and debris therefrom.

Description of the Related Art

During flooding events, for example hurricanes, cleanup operations can involve removal of water and debris from a flooded area (e.g. home, business). In some instances shafts (e.g., elevator shafts) can be flooded, making it difficult to remove water and debris therefrom, particularly as the shaft depth increases, due to difficulty in raising debris and liquid over great heights due to energy demands and strain on a pumping system.

SUMMARY

In accordance with one aspect of the invention, a buoy assembly with aeration ports can be lowered to the flooded area (e.g., in a shaft, such as an elevator shaft) and connected to a pumping system for siphoning water and debris from the flooded area, the buoy assembly facilitating the removal of such debris and liquid, even from deep shafts.

According to another aspect of the disclosure the inlet conduit that is coupled to the pumping system can be lowered significantly lower than the height the pumping system is resting on. An example is lowering the inlet conduit to the bottom of a well or shaft, such as an elevator shaft. On one end of the inlet conduit would be attached a buoy assembly, and the other end would be attached to the pumping system. The buoy assembly can be utilized to siphon debris (e.g., mud, silt, debris, rocks) from a well or a shaft. This with an ordinary inlet conduit would be difficult to achieve, the mass of the debris and the vertical distance the debris would have to travel requires a substantial amount of energy, creating strain on an ordinary pumping system, as well as the complexities of an inlet conduits limitations from debris obstructions as the pumping systems attempts to siphon a flooded area.

The buoy assembly comprises buoy aeration ports that facilitates the flow of air, water, and debris through the inlet conduit. The buoy aeration ports create aeration within the inlet conduit lowering the pressure internally of the inlet conduit and increasing the velocity of the water and debris that is traveling within the inlet conduit. The aeration creates lift within the inlet conduit that is utilized to exceed vertical heights of, for example, 25 ft.

According to another aspect of the disclosure the buoy assembly has 4 buoy aeration ports. In another design the buoy can include more than 4 buoy aeration ports to increase aeration of air, water, and debris. An example of the dimensions of the buoy assembly is a length of 15 inches, the narrowest diameter of the proximal tube is 1.5 inches, and the width of the threaded adaptor socket is 5 inches along with the largest diameter of the buoy. The example of the buoy assembly creates at least 5 lbs of buoyancy force however the design can be modified to increase buoyant force. The buoyant force of the buoy assembly is required to keep the buoy assembly afloat during the siphoning process. The buoyant force may also help dislodge debris from the bottom of the flooded area. Proper design can optimize lift with respect to size and weight of the buoy assembly.

In accordance with another aspect of the disclosure, a pumping system is provided. The pumping system comprises an inlet conduit and a chamber assembly in fluid communication with the inlet conduit. The chamber assembly comprises a plurality of chambers with internal directional baffles to direct the flow of water and media in the preferred direction within the chambers. The directional baffles are fixed angularly relative to the chambers and configured to direct a flow of fluid and debris toward one or more sensors in the chamber.

In accordance with another aspect of the disclosure, a pumping system is provided. The pumping system comprises an inlet conduit and a chamber assembly in fluid communication with the inlet conduit. The chamber assembly comprises a plurality of sensors and sensor protection devices for accurate determination of mass of water and media within the chamber. The sensor protection devices include a sensor sleeve and a sensor guard. An example dimension of the sensor sleeve is 0.125 inches thick and 20-25 mm long to fully cover the side of the sensor. An example dimension of the sensor guard is 2-3 inches long with a width sufficient to cover the sensor and depth of 20-25 mm to fully cover the sensor body. The sensor sleeve is placed over the sensors enclosing the circumference of the sensor and leaving exposed the sensor sensing input that faces inward to the chamber. The sensor guard is fixed on top of the sensor sleeve. The sensors can determine liquid levels as well as determine blockage within the chambers. The sensor protection devices can be oriented in a manner that protects the sensor from damage and false triggering.

In accordance with another aspect of the disclosure, a pumping system is provided. The pumping system comprises an inlet conduit and a chamber assembly in fluid communication with the inlet conduit. The pumping system also comprises a buoy assembly removably coupleable to an end of the inlet conduit and configured to be deployed in a flooded shaft for removal of debris and liquid therefrom. The buoy assembly comprises a buoy configured to float on a liquid surface and having one or more aeration ports selectively opened to allow airflow therethrough from outside the buoy to inside the buoy to facilitate lifting of liquid and debris along the inlet conduit toward the chamber assembly.

In accordance with another aspect of the disclosure, a pumping system is provided. The pumping system comprises a conduit and a pump coupleable to one end of the conduit and operable to apply a suction force to the conduit. The pumping system also comprises a buoy assembly removably coupleable to an opposite end of the conduit. The buoy assembly comprises a buoy configured to float on a liquid surface and having one or more aeration ports selectively opened to allow airflow therethrough from outside the buoy to inside the buoy to facilitate lifting of liquid and debris along the conduit toward the pump.

In accordance with another aspect of the disclosure, a pumping system is provided. The pumping system comprises a conduit and a pump coupleable to one end of the conduit and operable to apply a suction force to the conduit. The pumping system also comprises a distal conduit (e.g., rigid conduit) coupleable to an opposite end of the conduit. The distal conduit can have a length of about 10 inches. The pumping system also comprises a buoy assembly removably coupleable to an opposite end of the distal conduit. The buoy assembly comprises a buoy configured to float on a liquid surface and have one or more aeration ports selectively opened to allow airflow therethrough from outside the buoy to inside the buoy to facilitate lifting of liquid and debris via the distal conduit and the conduit toward the pump.

In accordance with another aspect of the disclosure, a pumping system is provided. The pumping system comprises a conduit and a pump coupleable to one end of the conduit and operable to apply a suction force to the conduit. The conduit may also comprise a plurality of removeable buoys attached in-line or alongside the conduit, spaced for example 2 ft apart, providing the conduit buoyancy to inhibit (e.g., prevent) abnormal tilting of a buoy assembly to optimize the operation of the buoy assembly. The pumping system also comprises a distal conduit coupleable to an opposite end of the conduit. The pumping system also comprises the buoy assembly removably coupleable to an opposite end of the distal conduit. The buoy assembly comprises a buoy configured to float on a liquid surface and have one or more aeration ports selectively opened to allow airflow therethrough from outside the buoy to inside the buoy to facilitate lifting of liquid and debris along the conduit toward the pump.

In accordance with another aspect of the disclosure, a pumping system is provided. The pumping system comprises a conduit and a pump coupleable to one end of the conduit and operable to apply a suction force to the conduit. The pumping system also comprises a buoy assembly removably coupleable to an opposite end of the conduit. The buoy assembly comprises a buoy configured to float on a liquid surface and have one or more aeration ports selectively opened to allow airflow therethrough from outside the buoy to inside the buoy to facilitate lifting of liquid and debris along the conduit toward the pump. The buoy assembly also comprises a conduit adapter distally located relative to the buoy. The conduit adapter is removably coupleable to an elbow conduit disposed between the adapter and the buoy, the elbow conduit having a bend (e.g., 90-degree bend, making the adapter socket perpendicular to the buoy).

In accordance with another aspect of the disclosure, in combination with a pumping system operable to remove debris and liquid from a flooded shaft via a conduit, a buoy assembly is provided. The buoy assembly comprises a buoy configured to float on a liquid surface and having one or more aeration ports selectively opened to allow airflow therethrough from outside the buoy to inside the buoy to facilitate lifting of liquid and debris along the conduit.

DETAILED DESCRIPTION

Overview

Figure 1A:
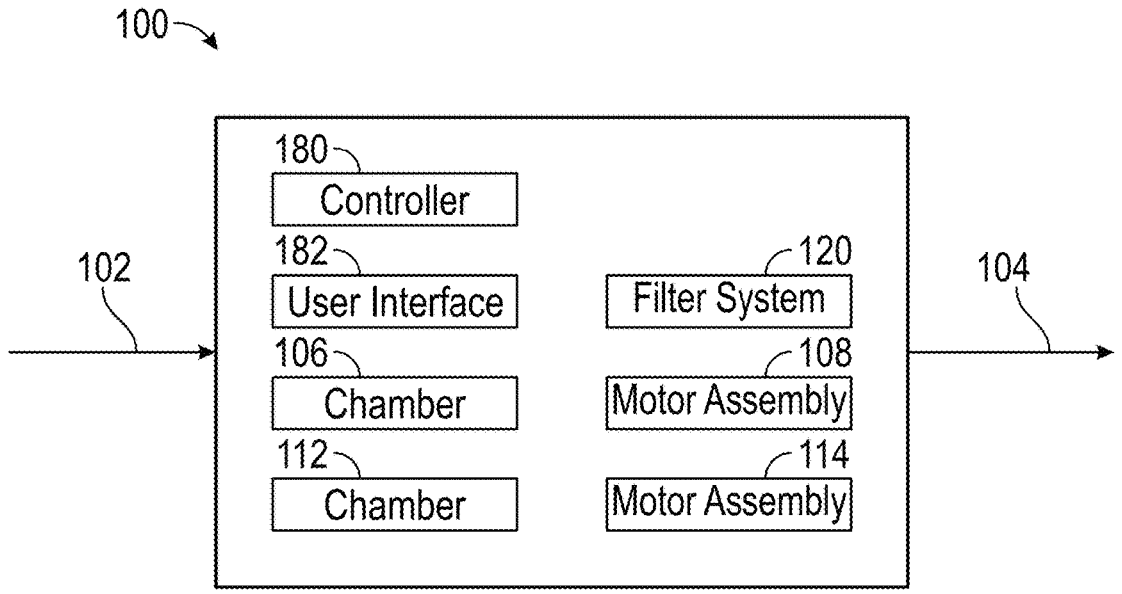
FIG. 1A is a block diagram of an example pumping system.

Referring to FIG. 1A, an example pumping system 100 is disclosed. The pumping system 100 can include an inlet conduit 102 and an outlet conduit 104. The inlet conduit 102 can allow materials having one or both liquid or solid to be siphoned into the pumping system 100 while the outlet conduit 104 can allow siphoned material to be removed from the pumping system 100. Optionally, the inlet conduit 102 and the outlet conduit 104 can be a flexible hose with an opening to allow materials to enter and/or exit. Optionally, the inlet conduit 102 can have an end attachment (e.g., wand) to facilitate siphoning different types of materials. The pumping system 100 can siphon various types of materials including organic wastes, inorganic wastes, gaseous or liquid substances including chemicals, floodwater, mud, silt, various types of gases, food products, and the like.

In some implementations, the pumping system 100 can be used to remove debris from flooded areas.

The pumping system 100 can include a first chamber 106, a first motor assembly 108, a second chamber 112, a second motor assembly 114, an optional filter system 120, a controller 180, and a user interface 182. Though FIG. 1A shows two chambers 106, 112 and two motor assemblies 108, 114, the pumping system 100 can have fewer (e.g. one) or more (e.g., three, four, etc.) of these components. In another implementation, the filter system 120 can be excluded.

A proximal (e.g., upstream) end of an optional filter system 120 can be in fluid communication with the inlet conduit 102 to receive debris entering the pumping system 100. A distal (e.g., downstream) end of the filter system 120 can be in fluid communication with a piping system, the first chamber 106, the second chamber 112, and the outlet conduit 104 of the pumping system 100. Additional details of the filter system 120 will be provided below.

Optionally, the filter system 120 can include a filter (e.g., basket) with openings sized to allow fluid and/or smaller sized debris objects (e.g., water, mud, silt, pebbles, etc.) to pass therethrough but capture larger solid debris objects (e.g., rocks, sticks). In some implementations, the filter system 120 can include a filter that can filter certain types of gas and/or gas molecules. In other implementations, the filter system 120 can include a filter that can filter certain types of liquids. For example, the filter system 120 may be able to filter oil from water.

The first chamber 106 and the second chamber 112 can be located downstream of and in fluid communication with the filter system 120. The first chamber 106 and the second chamber 112 can receive the fluid and/or smaller sized debris objects separated by the filter system 120. The first chamber 106 and the second chamber 112 can fill with the fluid and/or smaller sized debris separated by the filter system 120. In some examples, both the first chamber 106 and the second chamber 112 can simultaneously receive the fluid and/or smaller sized debris objects from the filter system 120. Alternatively, the first chamber 106 and the second chamber 112 do not simultaneously receive the fluid and/or smaller sized debris objects from the filter system 120. For example, the first chamber 106 can receive the fluid and/or smaller sized debris objects from the filter system 120 while the second chamber 112 may not receive the fluid and/or smaller sized debris objects from the filter system 120. Similarly, the second chamber may 110 receive the fluid and/or smaller sized debris objects from the filter system 120 while the first chamber 106 may not receive the fluid and/or smaller sized debris objects from the filter system 120. The first chamber 106 and second chamber 112 can alternatingly receive and/or fill with the fluid and/or smaller sized debris objects.

The first motor assembly 108 and the second motor assembly 114 can be in fluid communication with the first chamber 106 and the second chamber 112, respectively. The first motor assembly 108 can be operated to remove air from (e.g., apply a suction or negative pressure force on) or blow air into (e.g., apply a positive pressure force on) the first chamber 106. Similarly, the first motor assembly 108 can be operated to remove air from (e.g., apply a suction or negative pressure force on) or blow air into (e.g., apply a positive pressure force on) the first chamber 106. Further discussion of the operation of the motor assemblies 108, 114 with respect to the chambers 106, 112 will be provided further below.

The pumping system 100 can include a controller 180. The controller 180 can receive and/or send signals to different electrical components and/or parts of the pumping system 100. The controller 180 can generate electronic signals to control operation of the first motor assembly 108 and the second motor assembly 114. Optionally, the controller 180 can receive electronic signals from the chambers (for example, from sensors in or on the first chamber 106 and the second chamber 112) and can optionally control operation of the first motor assembly 108 and the second motor assembly 114 based at least in part on the received electronic signals from the chambers 106, 112, as further described below.

The pumping system 100 can include a user interface 182. The user interface 182 can optionally be attached to a frame or housing H of the pumping system 100. In another implementation, user interface 182 can be located remotely from the frame or housing H of the pumping system 100 and can communicate with the electronics (e.g., motor assemblies 108, 114, sensors, etc. in a wired or wireless manner. The user interface 182 can electrically communicate with the controller 180 (e.g., via a wired or wireless connection) such that the user interface 182 can send to and/or receive electronic signals from the controller 180. The user interface 182 can allow a user to control the operation of the pumping system 100 by communicating with the controller 180. In some implementations, the user interface 182 can be integrated to an application run on mobile devices such as a mobile phone, a tablet, a laptop, and the like.

For example, users can interact with the user interface 182 to control operation of the motor assemblies (for example, the first motor assembly 108 and the second motor assembly 114) to generate negative and/or positive pressures in the chambers (for example, the first chamber 106 and the second chamber 112). As discussed above, generating negative and positive pressures in the chambers can control flow of liquid through the pumping system 100. In this regard, by controlling operation of the motor assemblies via the user interface 182, users can control operation of the pumping system 100. Further discussion of the method of operation of the motor assemblies 108, 114 and the pumping system 100 is provided below.

Piping System

Figure 1B:
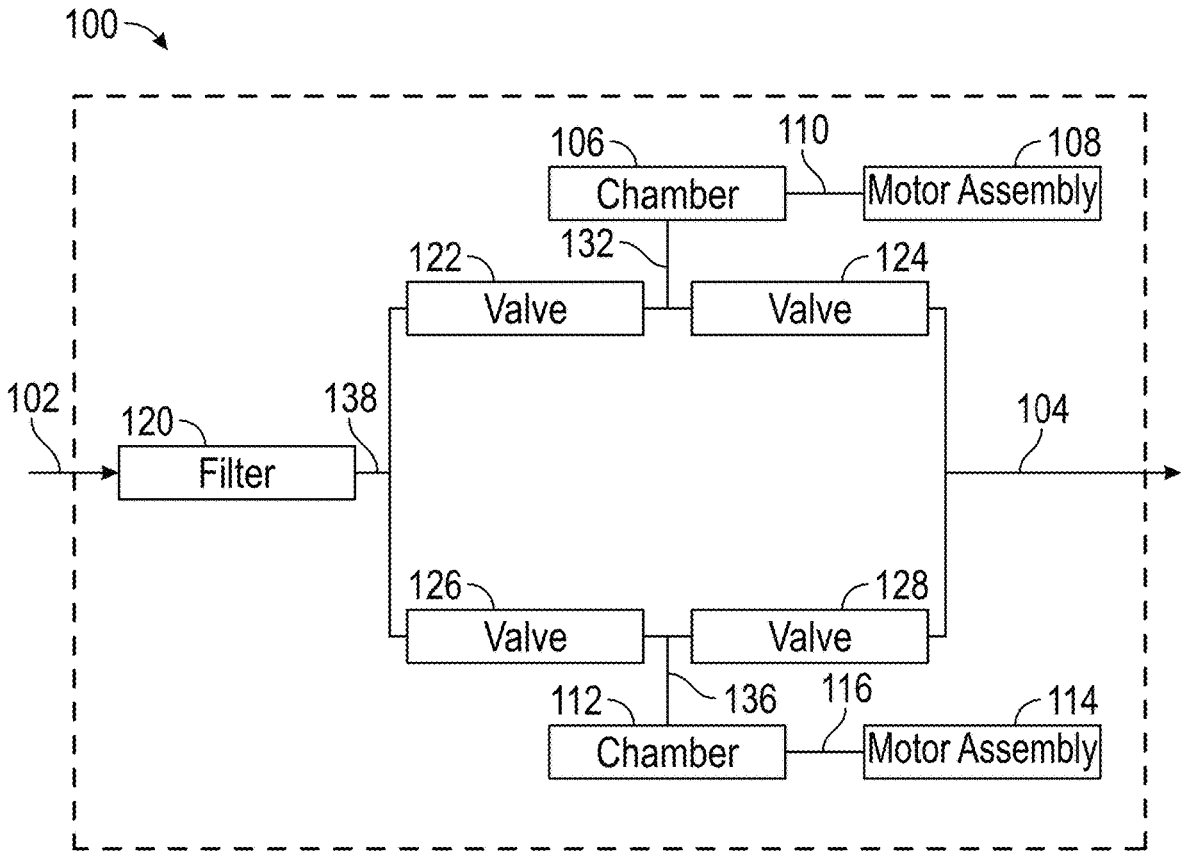
FIG. 1B is a block diagram showing additional details of the example pumping system of FIG. 1A.

FIG. 1B illustrates additional details of the pumping system 100. The pumping system 100 can include a conduit system that interconnects different components of the pumping system 100. As discussed above, the filter system 120 can be in fluid communication with the first chamber 106 and the second chamber 112. Additionally, the first chamber 106 and the second chamber 112 can be in fluid communication with the outlet conduit 104 and the first motor assembly 108 and the second motor assembly 114, respectively.

The filter system 120 can be in fluid communication with a conduit 138 to receive fluid and/or small sized debris objects exiting from the filter system 120. In the example pumping system 100 illustrated in FIGS. 1B and 1C, the conduit 138 is in fluid communication with a valve 122 and a valve 126. The valve 122 can allow the fluid and/or smaller sized debris objects exiting the filter system 120 to flow towards the first chamber 106 via the conduit 138, the valve 122, and a conduit 132. In some implementations, the valve 122 can be a check valve that only allows unidirectional flow. In this regard, the fluid and/or smaller objects exiting the filter system 120 can flow through the valve 122 and into the first chamber 106 but not the other way. Accordingly, the fluid and/or smaller sized debris objects cannot flow from the first chamber 106 to the filter system 120 via the valve 122.

The valve 126 can allow the fluid and/or smaller sized debris objects exiting the filter system 120 to flow to the second chamber 112 via the conduit 138, the valve 126, and a conduit 136. In some examples, the valve 126 can be a check valve that only allows unidirectional flow. In this regard, the fluid and/or smaller sized debris objects exiting the filter system 120 can flow through the valve 126 and into the second chamber 112 but not the other way. Accordingly, the fluid and/or smaller sized debris objects cannot flow from the second chamber 112 to the filter system 120 via the valve 126.

The conduit system of the pumping system 100 can include a valve 124 and a valve 128. The valve 124 can allow the fluid and/or smaller sized debris objects exiting the first chamber 106 via the conduit 132 to flow through the valve 124 and exit the pumping system 100 via the outlet conduit 104. In some examples, the valve 124 is a check valve that only allows unidirectional flow. The valve 124 can prevent debris and/or fluid flowing into the pumping system 100 via the outlet conduit 104 and through the valve 124 but not the other way. Likewise, the valve 128 can allow the fluid and/or smaller sized debris objects to exit the second chamber 112 via the conduit 136 and the valve 128 and exit the pumping system 100 via the outlet conduit 104. In some examples, the valve 128 is a check valve that only allows unidirectional flow. In this regard, the valve 128 can prevent fluid and/or smaller sized debris objects from flowing from the outlet conduit 104 to the second chamber 112 via the valve 128 but not the other way.

The valve 122 and the valve 124 can be in fluid communication with the conduit 132 and the first chamber 106. The valve 124 can be in fluid communication with the outlet conduit 104. The valve 126 and the valve 128 can be in fluid communication with the conduit 136 the second chamber 112. The 128 can be in fluid communication with the outlet conduit 104.

Example Pumping System

Figure 1C:
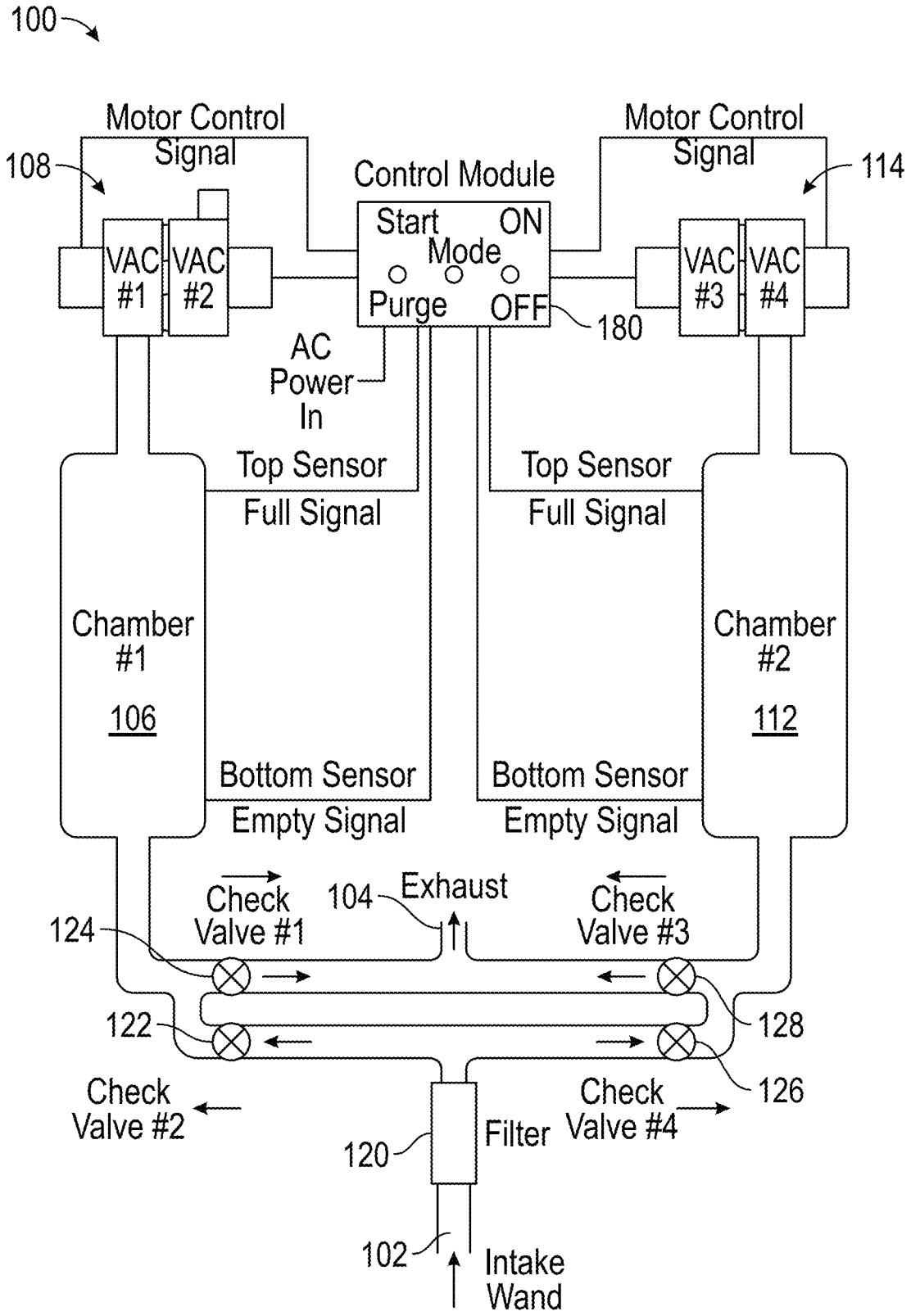
FIG. 1C is another block diagram showing additional details of the example pumping system of FIG. 1A.

An example of the pumping system 100 is illustrated in FIG. 1C. The inlet conduit 102 (or inlet wand) can allow material having one or more of fluid and solid to enter into the pumping system 100. As noted above, the material may be debris from flooded area. The filter system 120 can filter fluid and/or smaller sized debris objects from larger solid debris objects (e.g., rocks, sticks) and allow the fluid and/or smaller sized debris objects to flow into the first chamber 106 and/or the second chamber 112 via the valve 122 and valve 126, respectively, to fill the first chamber 106 and/or the second chamber 112. The fluid and/or smaller sized debris objects in the first chamber 106 and/or the second chamber 112 can then be emptied via the valve 124 and the valve 128, respectively. The fluid and/or smaller sized debris objects can be ejected from the pumping system 100 via the outlet conduit 104 (or exhaust).

The first chamber 106 and the second chamber 112 can be coupled to the first motor assembly 108 and the second motor assembly 114, respectively, via one or more conduits as previously described. Advantageously, the first and second chambers 106, 112 fill and empty without the motor assemblies 108, 114 coming in contact with the fluid and/or smaller sized debris objects that flow through the pumping system 100, thereby advantageously inhibiting (e.g., preventing) damage of the motor assemblies 108, 114.

The chambers 106, 112 can include one or more sensors 420, 422, 424, 426 (see FIGS. 4B-4C) that can detect presence and/or absence of liquid in the chambers 106, 112 and communicate such signals to the controller 180. The sensors 420, 422, 424, 426 may be capacitance sensors. However, the sensors 420, 422, 424, 426 can be other suitable type of sensors (e.g., optical sensors, ultrasonic sensors, proximity sensors, etc.). The sensors 420, 422, 424, 426 can generate electronic signals and transmit them to the controller 180 as shown in FIG. 1C. The controller 180 can use the electronic signals from the sensors 420, 422, 424, 426 to generate and transmit electronic signals for controlling operation of the motor assemblies 108, 114. The electronic signals from the controller 180 can cause the motor assemblies to blow air into (e.g., apply a positive pressure force on) or remove air from (e.g., apply a negative pressure force on) the chambers 106, 112. Additional details regarding the sensors 420, 422, 424, 426 and operation of the motor assemblies 108, 114 will be described further below.

The first chamber 106 and the second chamber 112 can optionally be transparent. This can be advantageous by allowing users to visually confirm operation of the pumping system 100. Additionally, transparent chambers can allow users to better troubleshoot operation of the pumping system 100 by visually monitoring suction/purge of filtered water in the chambers 106, 112.

The pumping system 100 and its various components (for example, the first motor assembly 108, the second motor assembly 114, the controller 180, and the user interface 182) can optionally receive power from an external power source (e.g., wall outlet, generator). Alternatively, the power source can be one or more batteries mounted on the frame or housing H of the pumping system 100. The controller 180 may receive power from the external power source and supply power to other components of the pumping system 100. Additionally and/or optionally, the controller 180 can transmit power to the motor assemblies.

Optionally, the controller 180 can have a wired and/or wireless communication capability (e.g., via radio frequency (RF) communication, Wi-Fi, BLUETOOTH®, etc.). In this regard, the controller 180 can communicate with other controllers 180 of other pumping systems 100.

Figure 1D:
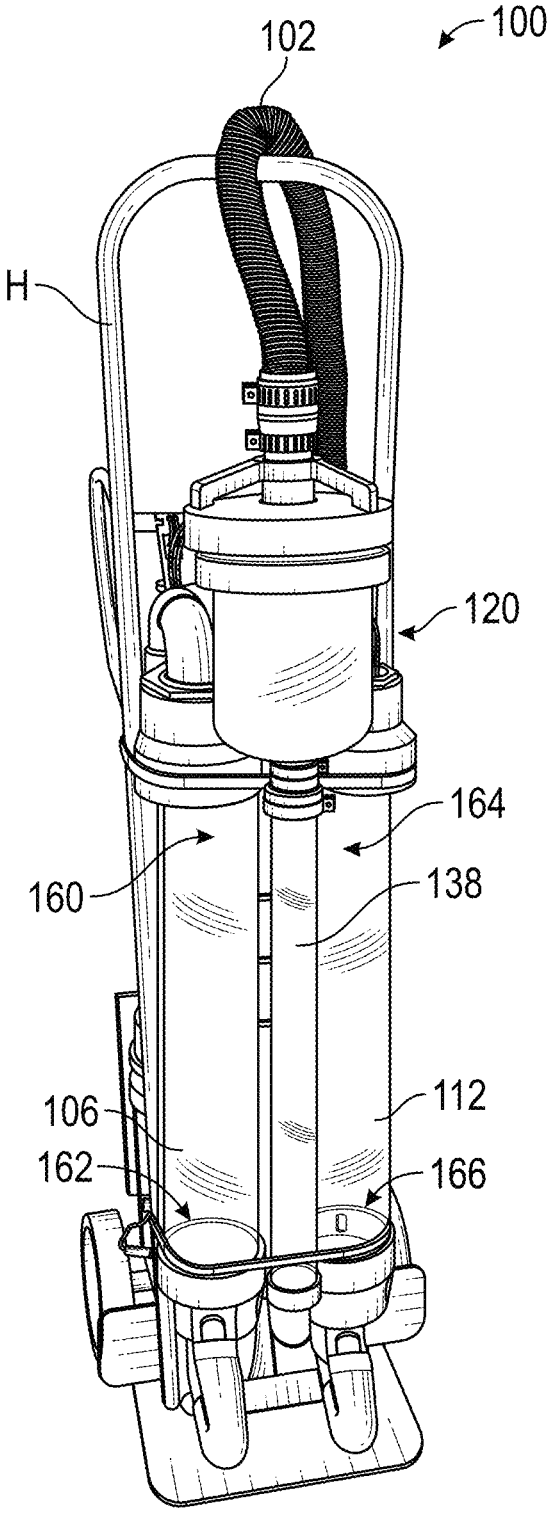
FIG. 1D is a perspective front view of the example pumping system of FIGS. 1A-1C.

FIG. 1D illustrates a front perspective view of an example pumping system 100. In this example, the inlet conduit 102 is in fluid communication with a top portion of the filter system 120. The conduit 138 can be in fluid communication with a bottom portion of the filter system 120. This configuration can advantageously allow the filter system 120 to utilize the gravitational force to filter fluid and/or smaller sized debris objects from the debris siphoned into the pumping system 100. Additionally and/or alternatively, this configuration can aid in inhibiting (e.g., preventing) the filtered liquid from exiting from the pumping system 100 via the filter system 120. The example pumping system 100 can include the first chamber 106 and the second chamber 112. However, as discussed previously, in another implementation, the system 100 can have fewer (e.g., one) or more (e.g., three, four, etc.) chambers and associated motor assemblies.

Motor Assembly

Referring to FIGS. 2A-2E, an example motor assembly of the pumping system 100 is described. As illustrated in FIGS. 1B and 1C, the pumping system 100 can include the first motor assembly 108 in fluid communication with the first chamber 106 and the second motor assembly 114 in fluid communication with the second chamber 112. The motor assemblies advantageously do not include a mechanical valve (e.g., between the motor assemblies 108, 114 and the chambers 106, 112) to divert between negative pressure (for example, to suction debris into the chambers 106, 112) and positive pressure (for example, to purge debris from the chambers 106, 112).

Figure 2A:
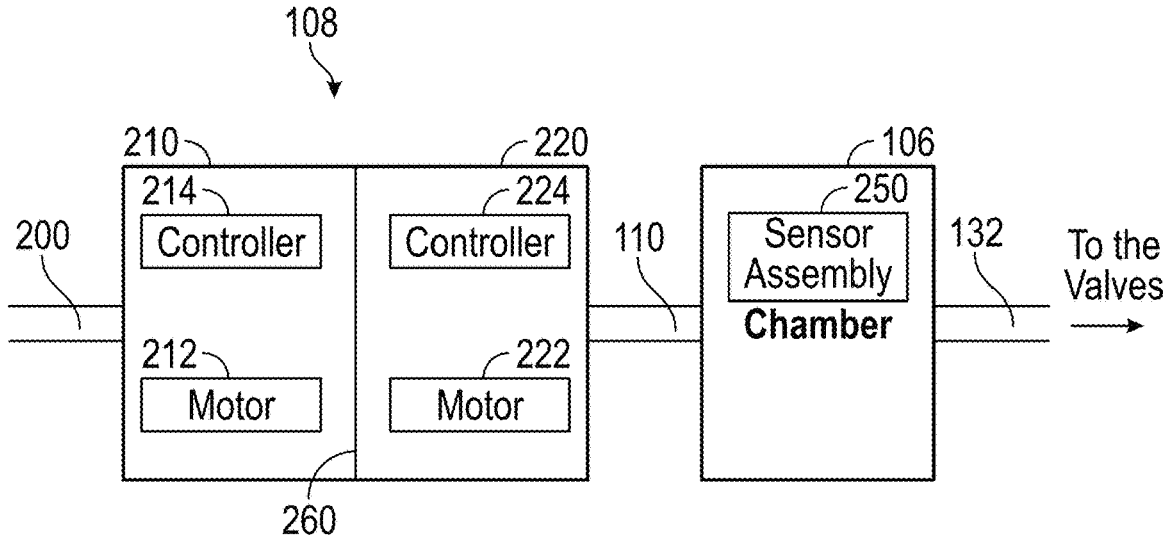
FIG. 2A is a block diagram of an example motor assembly.

FIG. 2A illustrates additional details of the first chamber 106 and the first motor assembly 108. The first chamber 106 and the first motor assembly 108 can be in fluid communication via a conduit 110. The conduit 110 can be attached to the top portion 160 of the first chamber 106. The first chamber 106 can be in fluid communication with the conduit 132, which can act as an inlet and an outlet for the first chamber 106. The first chamber 106 can include a sensor assembly 250.

The first motor assembly 108 can include a device 210 and a device 220. The devices 210, 220 can be vacuum motors mounted back-to-back to each other (e.g., via a mounting plate) such that the device 210 operates as a blower and the device 220 operates as a vacuum relative to the chamber 106. In some implementations, the devices 210, 220 are housed within the same cavity. The devices 210, 220 of the first motor assembly 108 can function as a motorized bellow that introduces air into and/or removes air from the chamber 106.

The device 210 can include a controller 214 and a motor 212. The controller 214 can receive electronic signals from the controller 180 (see FIG. 1C) and operate the motor 212. The device 210 can blow air into the first chamber 106 by actuating the motor 212. Operation of the device 210 can generate positive pressure in the first chamber 106 (e.g., to displace debris in the chamber 106 out of the chamber 106 via conduit 132).

The device 220 can include a controller 224 and a motor 222. The controller 224 can receive electronic signals from the controller 180 (see FIG. 1C) and operate the motor 222. The device 220 can remove air from the first chamber 106 by actuating the motor 222. Operation of the device 220 can generate negative pressure in the first chamber 106 (e.g., to suction debris into the chamber 106 via conduit 132). The controller 180 (see FIG. 1C) may not operate the device 210 and the device 220 of the first motor assembly 108 simultaneously.

The first motor assembly 108 can advantageously not include a diverter valve that diverts negative pressure (e.g., suction) and positive pressure (e.g., purge). By having the devices 210, 220 coupled back-to-back and sharing the same cavity, the devices 210, 220 can operate in an alternating fashion that does not require a diverter valve to effectuate suction into or purge out of the first chamber 106. The devices 210, 220 may both be coupled to a mounting plate 260. The mounting plate 260 can include a cut-out that allows the devices 210, 220 to be in fluid communication (e.g., without any valves or other obstructions in the fluid path between the devices 210, 220).

Figure 2B:
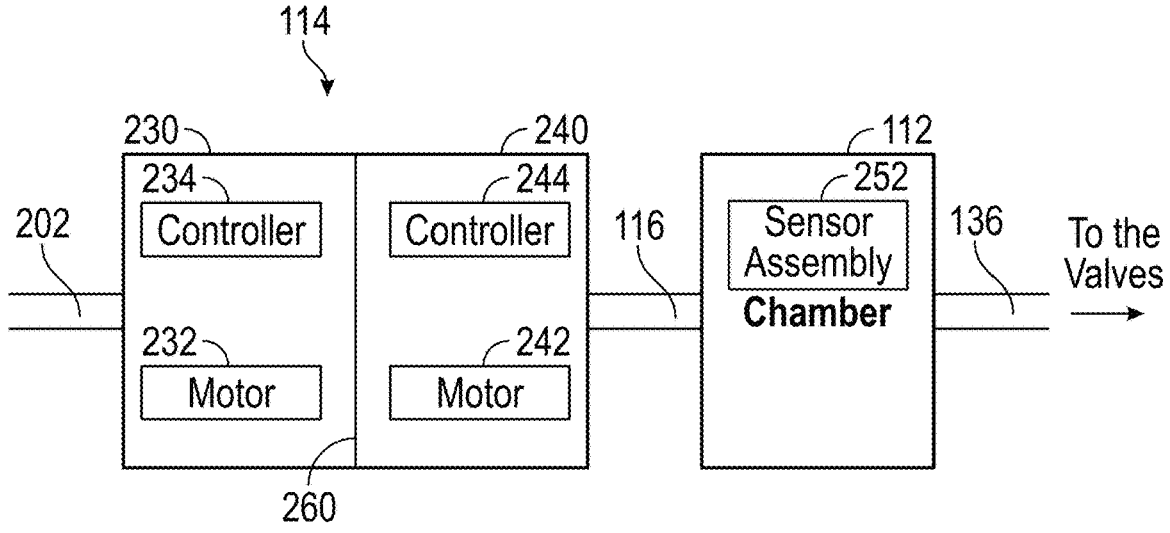
FIG. 2B is a block diagram of another example motor assembly.

FIG. 2B illustrates additional details of the second chamber 112 and the second motor assembly 114. The second chamber 112 and the second motor assembly 114 can be in fluid communication via a conduit 116. The conduit 116 can be attached to a top portion 164 of the second chamber 112. The second chamber 112 can be in fluid communication with the conduit 136, which can act as an inlet and an outlet for the second chamber 112. The second chamber 112 can include a sensor assembly 252.

The second motor assembly 114 can include a device 230 and a device 240. The devices 210, 220 can be vacuum motors mounted back to back to each other (e.g., via a mounting plate) such that the device 230 operates as a blower and the device 240 operates as a vacuum relative to the chamber 112. In some implementations, the devices 230, 240 are housed within the same cavity. The first device 230 and the second device 240 of the first motor assembly 108 can function as a motorized bellow that introduces air into and/or removes air from the chamber 112.

The device 230 can include a controller 234 and a motor 232. The controller 234 can receive electronic signals from the controller 180 (see FIG. 1C) and operate the motor 232. The device 230 can blow air into the second chamber 112 by actuating the motor 232. Operation of the device 240 can generate positive pressure in the second chamber 112 (e.g., to displace debris in the chamber 112 out of the chamber 112, such as via conduit 136).

The device 240 can include a controller 244 and a motor 242. The controller 244 can receive electronic signals from the controller 180 (see FIG. 1C) and operate the motor 242. The second device 240 can remove air from the second chamber 112 (e.g., to suction debris into the chamber 112 via conduit 136) by actuating the motor 242. Operation of the device 240 can generate negative pressure in the second chamber 112. The controller 180 may not operate the device 230 and the device 240 of the second motor assembly 114 simultaneously.

The second motor assembly 114 may not include a diverter valve that diverts the negative pressure and positive pressure. As noted above, by having the devices 230, 240 coupled back-to-back and sharing the same cavity, the devices 230, 240 can operate in an alternating fashion that does not require a diverter valve to effectuate suction into or purge out of the second chamber 112. The devices 230, 240 may both be coupled to the mounting plate 260. The mounting plate 260 can include a cut-out that allows the devices 230, 240 to be fluidly coupled (e.g., without any valves or other obstructions in the fluid path between the devices 230, 240).

Figure 2C:
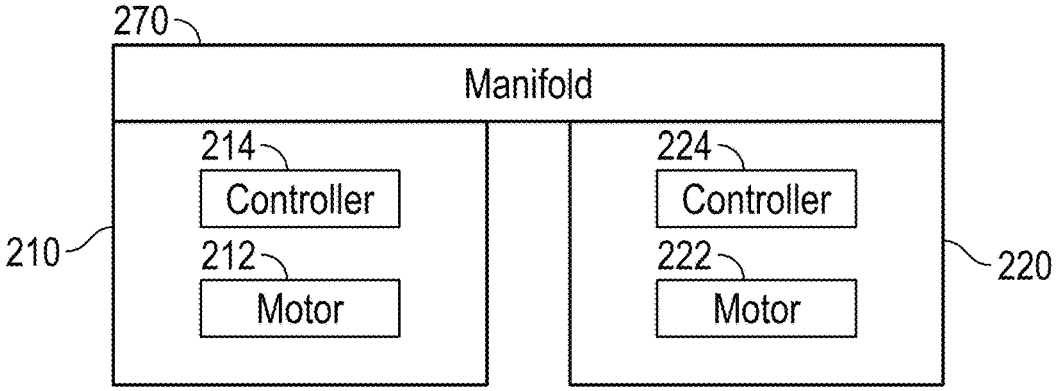
FIG. 2C is a block diagram of an example motor assembly with a different configuration.
Figure 2D:
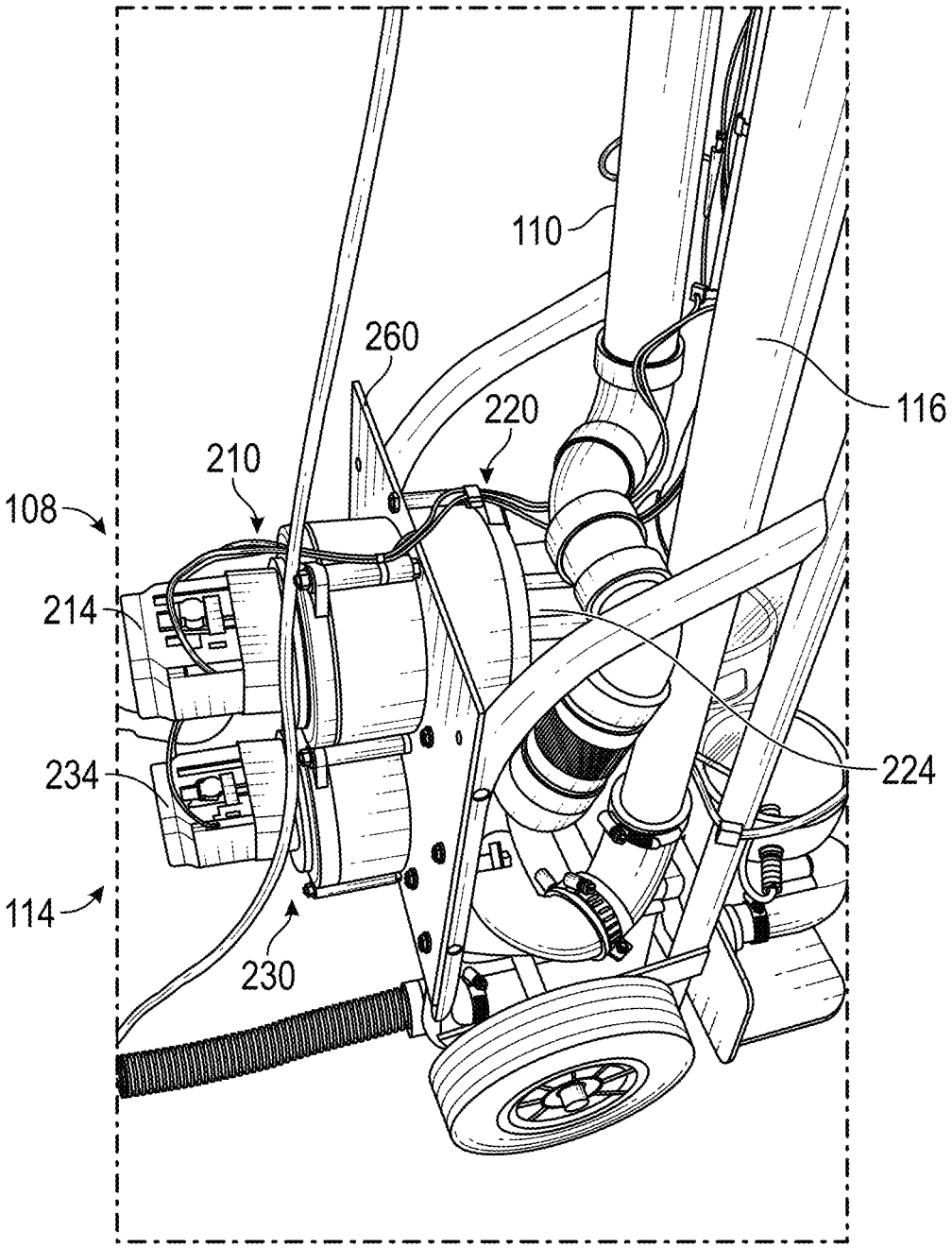
FIG. 2D is a partial left side and rear view of the pumping system in FIG. 1D showing example chamber assemblies and example motor assemblies.

Optionally, the devices 210, 220 and the devices 230, 240 can share the same mounting plate 260 (see FIG. 2D). Alternatively, the devices 210, 220 and the devices 230, 240 may not share the same mounting plate and have separate mounting plates.

The negative pressure in the chambers (for example, the first chamber 106 and the second chamber 112) can generate sufficient amount of suction force to siphon the debris into the pumping system 100. Additionally and/or alternatively, the suction force generated by the negative pressure can cause the debris to enter the filter system 120 and separate the fluid and/or smaller sized debris objects from the larger solid debris objects (e.g., rocks, sticks). Additionally and/or alternatively, the negative pressure can cause the fluid and/or smaller sized debris objects to leave the filter system 120 and enter the chambers (for example, the first chamber 106 and the second chamber 112).

Optionally, negative pressure in the first chamber 106 can cause the debris to enter the pumping system 100 via the inlet conduit 102 and the filter system 120 and route the fluid and/or smaller sized debris objects filtered by the filter system 120 to the first chamber 106 via the conduit 138, the valve 122, and the conduit 132. Optionally, negative pressure in the second chamber 112 can cause the debris to enter the pumping system 100 via the inlet conduit 102 and the filter system 120 and route the fluid and/or smaller sized debris objects filtered by the filter system 120 to the second chamber 112 via the conduit 138, the valve 126, and the conduit 136.

The positive pressure in the chambers (for example, the first chamber 106 and the second chamber 112) can eject the fluid and/or smaller sized debris objects stored in the chambers from the chambers. Additionally and/or alternatively, the positive pressure in the chambers can cause the fluid and/or smaller sized debris objects stored in the chamber to eject from the pumping system 100 via the outlet conduit 104.

Optionally, positive pressure in the first chamber 106 can remove the fluid and/or smaller sized debris objects stored in the first chamber 106. The fluid and/or smaller sized debris objects can flow out from the first chamber 106 via the conduit 132 and through the valve 124. The positive pressure can additionally eject the fluid and/or smaller sized debris objects from the pumping system 100 via the outlet conduit 104. Optionally, positive pressure in the second chamber 112 can remove the fluid and/or smaller sized debris objects stored in the second chamber 112. The fluid and/or smaller sized debris objects can flow out from the second chamber 112 via the conduit 136 and through the valve 128. The positive pressure can additionally eject the fluid and/or smaller sized debris objects from the pumping system 100 via the outlet conduit 104.

Optionally, the device 210 and the device 220 of the first motor assembly 108 (or the device 230 and the device 240 of the second motor assembly 114) may share a single controller that receives electronic signals from the controller 180. The single controller may communicate with the motor 212 and the motor 222 (or the motor 232 and the motor 242) to generate negative or positive pressure in the first chamber 106 (or the second chamber 112).

Optionally, the device 210 and the device 220 of the first motor assembly 108 (or the device 230 and the device 240 of the second motor assembly 114) may directly receive electronic signals from the controller 180 (e.g., the controllers 214, 224, 234, 244 can be excluded). In this regard, the controller 180 can directly communicate with the motors of the motor assemblies to generate negative and positive pressure in the chambers.

Optionally, the device 210 and the device 220 of the motor assembly 108, and device 230 and the device 240 of the motor assembly 114 may not be coupled back-to-back as described above. As shown in FIG. 2C, the device 210 and the device 220 of the motor assembly 108 may be coupled to a manifold 270 in parallel. The manifold 270 can define a space (e.g., flow path, conduit) that is coupled to both the device 210 and the device 220 such that the devices 210, 220 are fluidly coupled to the first chamber 106. The manifold 270 can be directly coupled to the first chamber 106 via the conduit 110. Optionally, the devices 230, 240 of the motor assembly 114 may be coupled in the same manner shown in FIG. 2C.

Figure 2E:
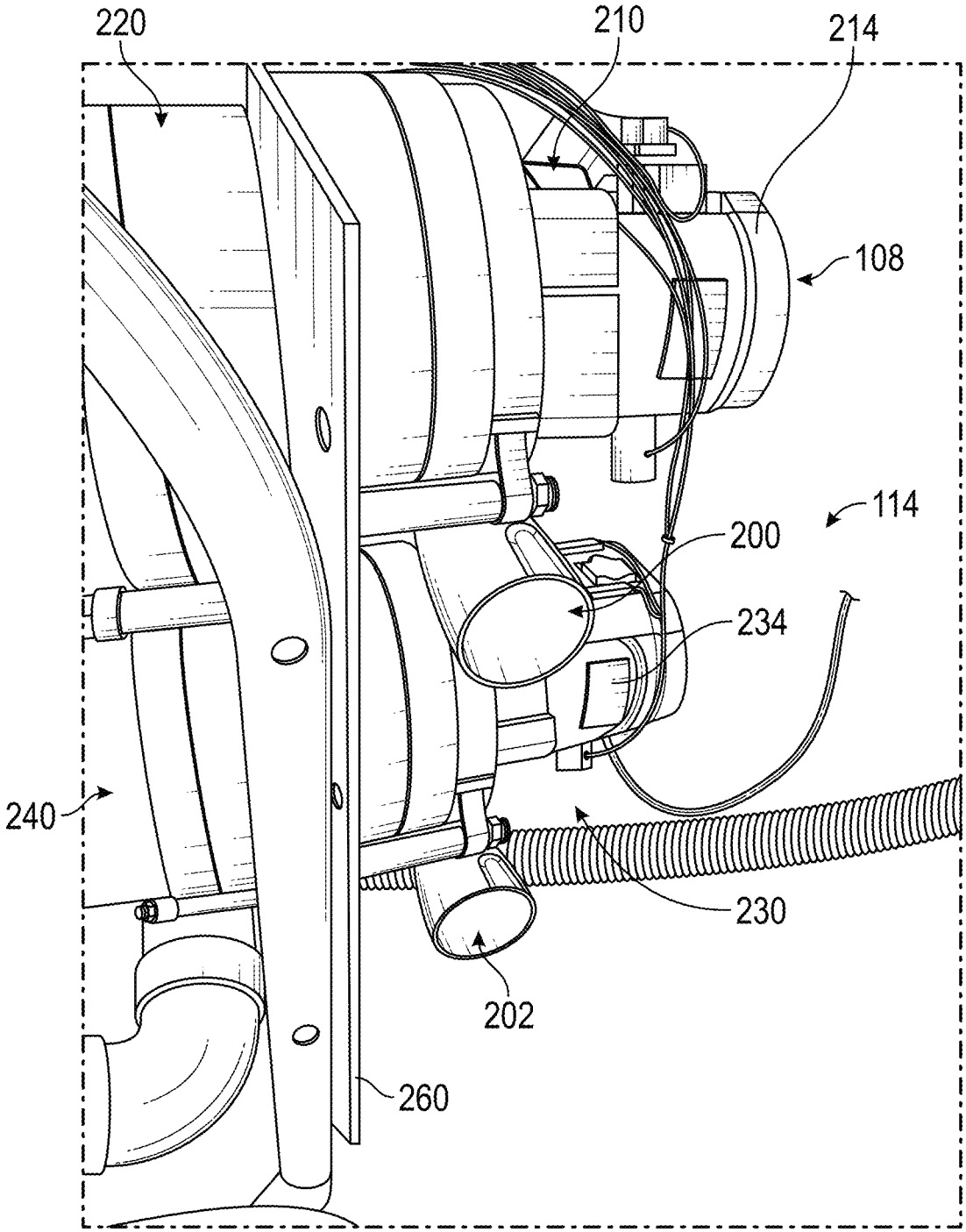
FIG. 2E is a partial right side view of the pumping system of FIG. 1D, showing example motor assemblies.

FIGS. 2D and 2E illustrate the motor assemblies 108, 114 of an example pumping system 100. As discussed above, the pumping system 100 can include the first motor assembly 108 that includes the device 210 and the device 220 (e.g., two vacuum motors 210, 220), and the second assembly 114 that includes the device 230 and the device 240 (e.g., two vacuum motors 230, 240).

The device 210 and the device 220 of the first motor assembly 108 can be coupled via a mounting plate 260. Additionally and/or alternatively, the device 210 and the device 220 can share a cavity or flow path such that air can flow within the first motor assembly 108 between the conduit 110 and an intake/exhaust opening 200 (see FIG. 2D) (e.g., depending on whether the motor assembly 108 is being operated to generate positive pressure in the chamber 106 or to generate negative pressure in the chamber 106). Likewise, the device 230 and the device 240 of the second motor assembly 114 can be coupled. Additionally and/or alternatively, the device 230 and the device 240 can share a cavity or flow path such that air can flow within the second motor assembly 114 between the conduit 116 and an intake/exhaust opening 202 (see FIG. 2D) (e.g., depending on whether the motor assembly 114 is being operated to generate positive pressure in the chamber 112 or to generate negative pressure in the chamber 112).

The openings (for example, the opening 200 and the opening 202) can act as an air inlet and outlet for the motor assemblies (for example, the first motor assembly 108 and the second motor assembly 114). When the device 210 operates and blows air into (e.g., generates positive pressure in) the first chamber 106, the air can enter the opening 200 and flows through the device 210 and the device 220. Alternatively, when the device 220 operates and removes air from (e.g., generates negative pressure in) the first chamber 106, the air can exit through the device 210, the device 220, and the opening 200. Similarly, the opening 202 can act as an air inlet and outlet for the second motor assembly 114.

Sensor System

Referring to FIGS. 1C, 2A, and 2B, sensor systems of the pumping system 100 are described. The chambers 106, 112 of the pumping system 100 can each include one or more sensors. The first chamber 106 can include the sensor assembly 250, which can have one or more sensors, and the second chamber 112 can include the sensor assembly 252, which can have one or more sensors. The sensor assembly 250 and the sensor assembly 252 can sense one or more parameters of the chambers 106, 112, generate one or more electronic signals corresponding to said sensed parameters, and send the electronic signals to the controller 180 (see FIG. 1C). In one implementation, the controller 180 can determine the amount (e.g., level) of debris (e.g., fluid and/or smaller sized debris objects) present in the first chamber 106 and the second chamber 112, respectively. The controller 180 can control the operation of the motor assemblies 108, 114 based at least in part on the one or more electronic signals it receives from the sensor assemblies 250, 252.

The sensor assemblies 250, 252 can each include one or more sensors that can detect the presence of liquid. The sensors can be any suitable liquid level sensors. Optionally, the sensor assembly (for example, the sensor assembly 250 or 252) can include capacitance level sensors that generate electronic signals upon detecting a change in capacitance caused by liquid contacting a probe (e.g., a probe that extends into the space within the chamber 106, 112). In one implementation, the sensors can generate electronic signals when no water is detected. The controller 180 can receive the electronic signals from the sensors to determine the amount of liquid present in the chambers (for example, the first chamber 106 and the second chamber 112); for example, the controller 180 can receive the electronic signals from the sensors to determine if the chamber (e.g., chamber 106 or 112) has reached a "full" level and needs to be emptied, or if the chamber (e.g., the chamber 112 or 106) has reached an "empty" level and needs to be filled with debris (e.g., fluid and/or smaller sized debris objects, such as mud, silt, pebbles).

The sensor assembly 250 of the first chamber 106 can include a sensor 422 and a sensor 420 (see FIG. 4B), where the sensor 422 is attached at or proximate a bottom portion 162 of the first chamber 106 and the sensor 420 is attached at or proximate the top portion 160 of the first chamber 106. In this regard, the controller 180 can determine the amount of (e.g., level of) fluid (e.g., liquid and/or smaller sized debris objects) in the first chamber 106 by monitoring signals received from the sensor 420 and the sensor 422. For example, the controller 180 may determine that the first chamber 106 is full or substantially full when it receives electronic signals indicative of presence of fluid (e.g., liquid and/or smaller sized debris objects) from both the sensor 420 and the sensor 422. Additionally and/or alternatively, the controller 180 may determine that the first chamber 106 is full or substantially full when it does not receive electronic signals indicative of absence of fluid (e.g., liquid and/or smaller sized debris objects) from both the sensor 420 and the sensor 422.

Optionally, the controller 180 may determine that the first chamber 106 is empty or substantially empty when it receives electronic signals indicative of absence of fluid (e.g., liquid and/or smaller sized debris objects) from the sensor 422 and the sensor 420. Additionally and/or alternatively, the controller 180 may determine that the first chamber 106 is empty or substantially empty when it does not receive electronic signals indicative of presence of fluid (e.g., liquid and/or smaller sized debris objects) from the sensor 422 and the sensor 420.

Optionally, the controller 180 may determine that the first chamber 106 is neither full nor empty when it receives an electronic signal indicative of presence of water from the sensor 422 and does not receive an electronic signal indicative of presence of water from the sensor 420. Additionally and/or alternatively, the controller 180 may determine that the first chamber 106 is neither full nor empty when it receives an electronic signal indicative of absence of water from the sensor 420 and does not receive an electronic signal indicative of absence of water from the sensor 422.

Likewise, the sensor assembly 252 of the second chamber 112 can include a sensor 424 and a sensor 426 (see FIG. 4B) that can communicate with the controller 180. The sensor 424 can be attached to or proximate the top portion 164 of the second chamber 112. The sensor 426 can be attached to or proximate a bottom portion 166 of the second chamber 112. As discussed above, the controller 180 can monitor electronic signals from the sensor 424 and the sensor 426 to determine the amount of fluid (e.g., liquid and/or smaller sized debris objects) stored in the second chamber 112.

Filter System

Figure 3:
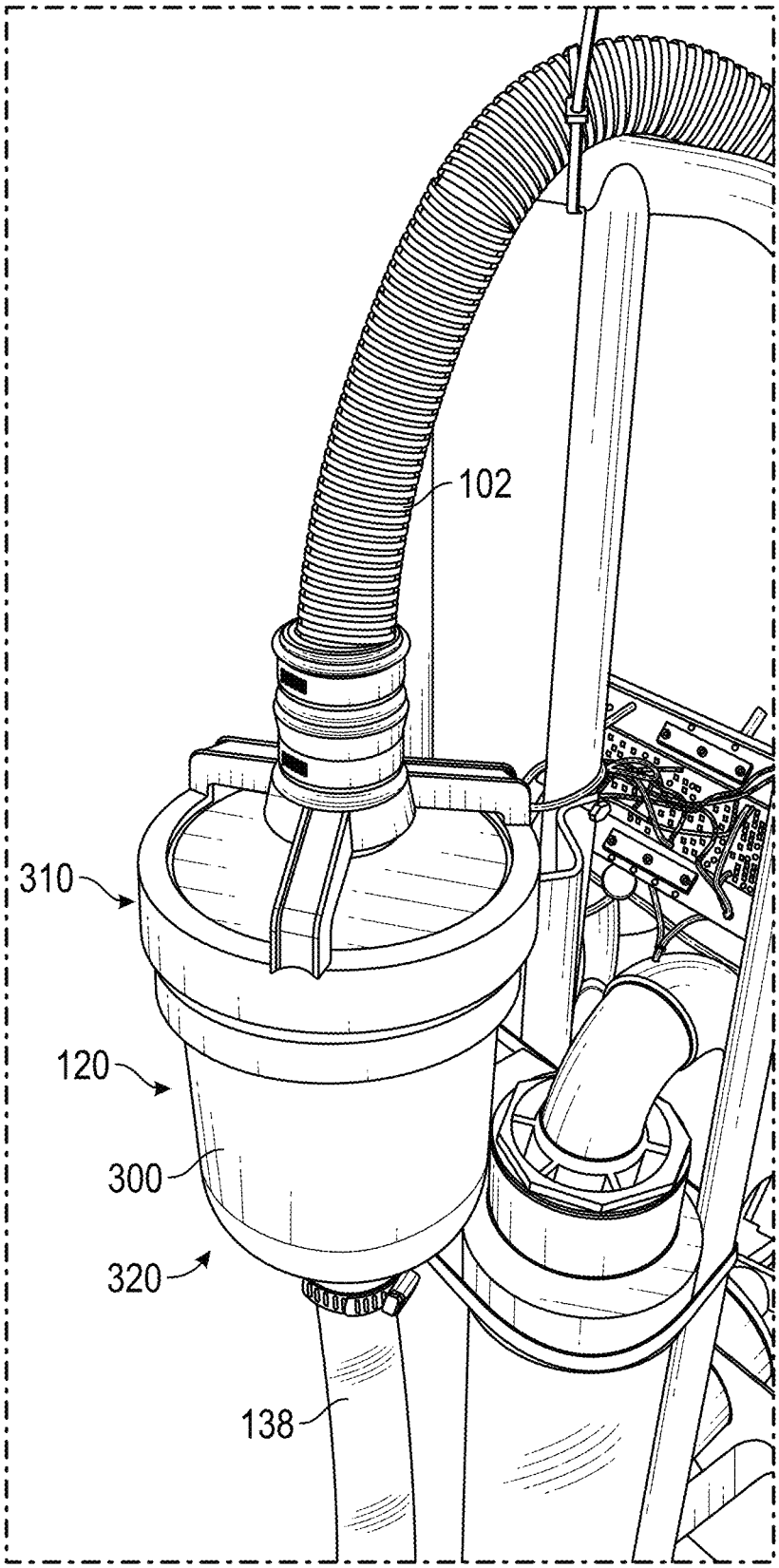
FIG. 3 is a partial perspective front view of the pumping system of FIG. 1D, showing a filter assembly.

FIG. 3 illustrates an example an optional filter system 120 of the pumping system 100. The filter system 120 can include a cavity 300 and a filter that can separate liquid and/or small sized debris objects (e.g., mud, silt, pebbles) from larger sized debris objects (e.g., rocks, sticks). The filter can be placed within the cavity 300. The filter system 120 can be oriented such that gravitational forces can be utilized in its filtering process. For example, an inlet 310 of the filter system 120 can be located above an outlet 320 of the filter system 120 to further facilitate the filtering process. The filter system 120 can include one or more filters having different or same mesh size. Having filters with different mesh sizes can advantageously allow the pumping system 100 to effectively separate liquid and different types of debris (for example, gravel, silt, and the like) from larger types of debris (e.g., rocks, sticks). In another implementation, the filter system 120 can separate liquid from all other debris (e.g., gravel, silt, rocks, sticks, and the like).

The pumping system 100 can include one or more filter systems in various locations. Optionally, the pumping system 100 can include filter systems integrated to its chambers. Additionally or alternatively, the pumping system 100 can include filter systems integrated to or coupled to each valves (for example, the valve 122, the valve 124, the valve 126, and the valve 128).

Example Method of Debris Removal

Figure 4A:
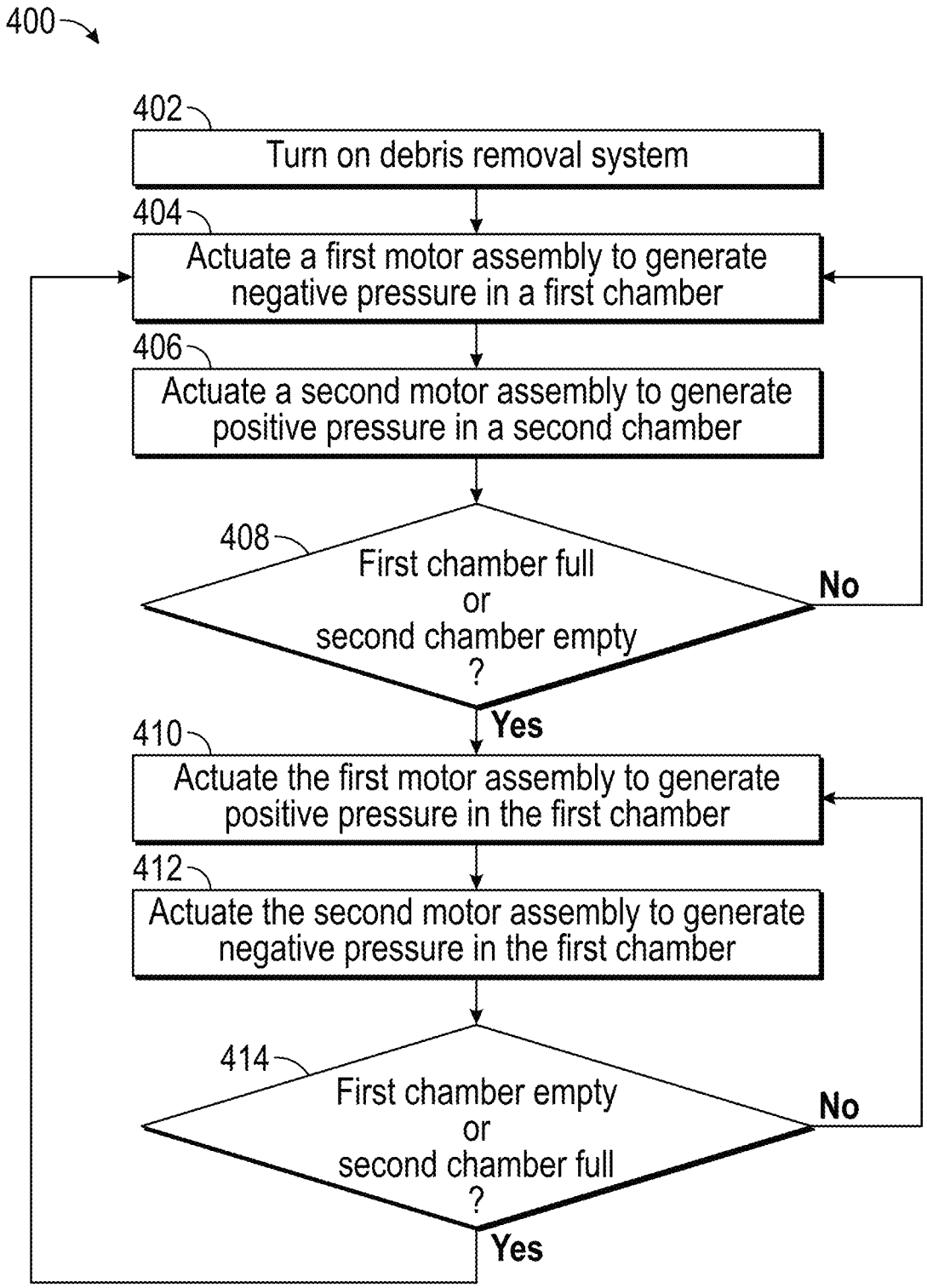
FIG. 4A is an example method of removing debris using the example pumping system of FIGS. 1A-1D.

FIG. 4A illustrates a method 400 of removing debris using the pumping system 100. At step 402, the pumping system 100 is actuated. Users can actuate the pumping system 100 via the user interface 182. The user can interact with the user interface 182 to control operation of the pumping system 100. For example, actuating the pumping system 100 can cause one of the first motor assembly 108 and the second motor assembly 114 to generate negative pressure in one of the first chamber 106 and the second chamber 112, and can cause the other of the first motor assembly 108 and the second motor assembly 114 to generate positive pressure in the other of the first chamber 106 and the second chamber 112.

Additionally or alternatively, the user can, via the user interface 182, actuate the first motor assembly 108 and the second motor assembly 114 to simultaneously generate negative pressure in the first chamber and the second chamber.

At step 404, the first motor assembly 108 generates negative pressure in the first chamber 106. The negative pressure in the first chamber 106 can be generated by the device 210 or the device 220 (e.g., vacuum motors) of the first motor assembly 108. The controller 180 can generate electronic signals to the controller 214 (or the controller 224) of the device 210 (or the device 220) to cause the motor 212 (or the motor 222) to generate negative pressure in the first chamber 106. As discussed above, the device 210 can generate negative pressure in the first chamber 106 by removing air from the first chamber 106. Alternatively, the device 220 can generate negative pressure in the first chamber 106 by removing air from the first chamber 106. The negative pressure created in the first chamber 106 can siphon debris into the pumping system 100 via the inlet conduit 102. Additionally, the negative pressure in the first chamber 106 can cause the fluid and/or smaller sized debris objects filtered by the filter system 120 to enter into the first chamber 106 via the conduit 138, the valve 122, and the conduit 132.

At step 406, the second motor assembly 114 generates positive pressure in the second chamber 112. The positive pressure in the second chamber 112 can be generated by the device 230 or the device 240 (e.g., vacuum motors) of the second motor assembly 114. The controller 180 can generate electronic signals to the controller 234 (or the controller 244) of the device 230 (or the device 240) to cause the motor 232 (or the motor 242) to generate positive pressure in the second chamber 112. As discussed above, the device 230 can generate positive pressure in the second chamber 106 by blowing air into the second chamber 112. Alternatively, the device 230 can generate positive pressure in the second chamber 112 by blowing air into second chamber 112. The positive pressure created in the second chamber 112 can eject fluid and/or smaller sized debris objects stored in the second chamber 112 and the pumping system 100 via the conduit 136, the valve 128, and the outlet conduit 104. Optionally, steps 404 and 406 occur simultaneously.

At step 408, the controller 180 can determine whether the first chamber 106 is full and/or the second chamber 112 is empty. The controller 180 can receive electronic signals from the sensors (for example, the sensor 420, the sensor 422, the sensor 424, and the sensor 426) coupled to the first chamber 106 and the second chamber 112 to determine whether the chambers are full, empty, or neither full nor empty.

If the controller 180 determines that either the first chamber 106 is full and/or the second chamber 112 is empty, the controller 180 can send electronic signals to the first motor assembly 108 to generate positive pressure in the first chamber 106 at step 410. If the controller 180 determines that first chamber is not full and the second chamber is not empty, the controller 180 can send electronic signals to the first motor assembly 108 to generate negative pressure in the first chamber 106 at step 404.

At step 412, the controller 180 can send electronic signals to the second motor assembly 114 to generate negative pressure in the second chamber 112.

At step 414, the controller can determine whether the first chamber 106 is empty and/or the second chamber 112 is full using electronic signals received from the sensors (for example, the sensor 420, the sensor 422, the sensor 424, and the sensor 426) coupled to the first chamber 106 and the second chamber 112.

If, at step 414, the controller 180 determine that either the first chamber 106 is empty or the second chamber 112 is full, the controller 180 can send electronic signals to the first motor assembly 108 to generate negative pressure in the first chamber 106 at step 404. If, at step 414, the controller 180 determined that the first chamber is not empty and the second chamber is not full, the controller 180 can send electronic signals to the first motor assembly 108 to generate positive pressure in the first chamber 106 at step 410.

Example Operation of Pumping System

Figure 4B:
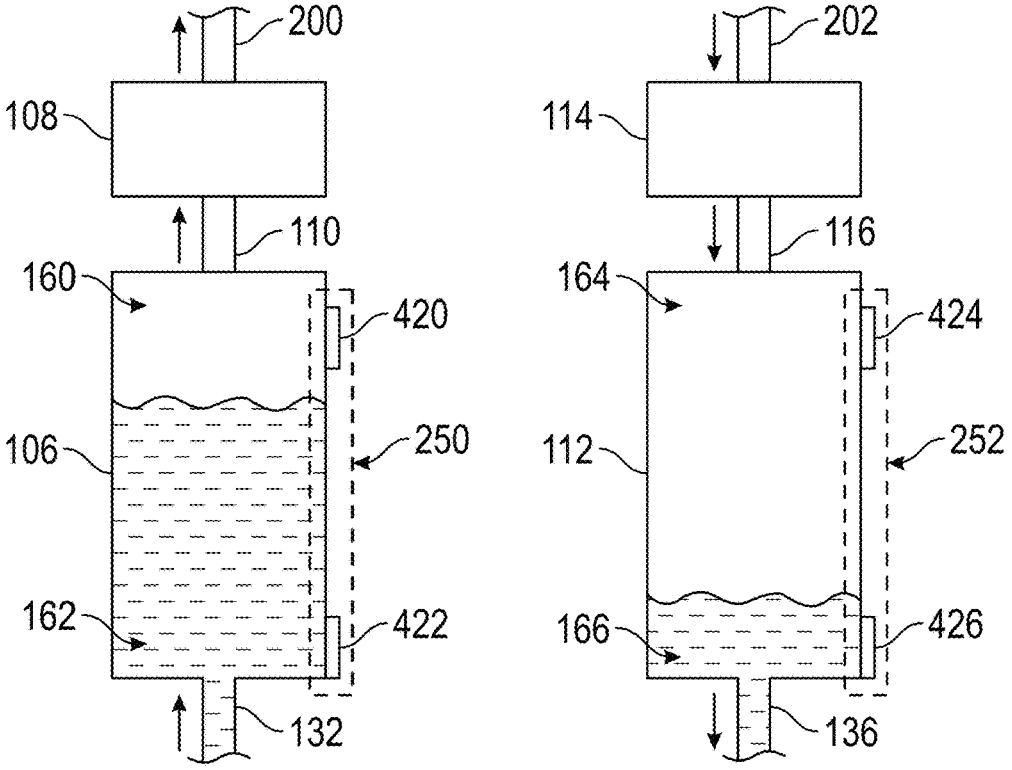
FIGS. 4B and 4C are illustrations of the method of removing debris using the example pumping system of FIGS. 1A-1D.
Figure 4C:
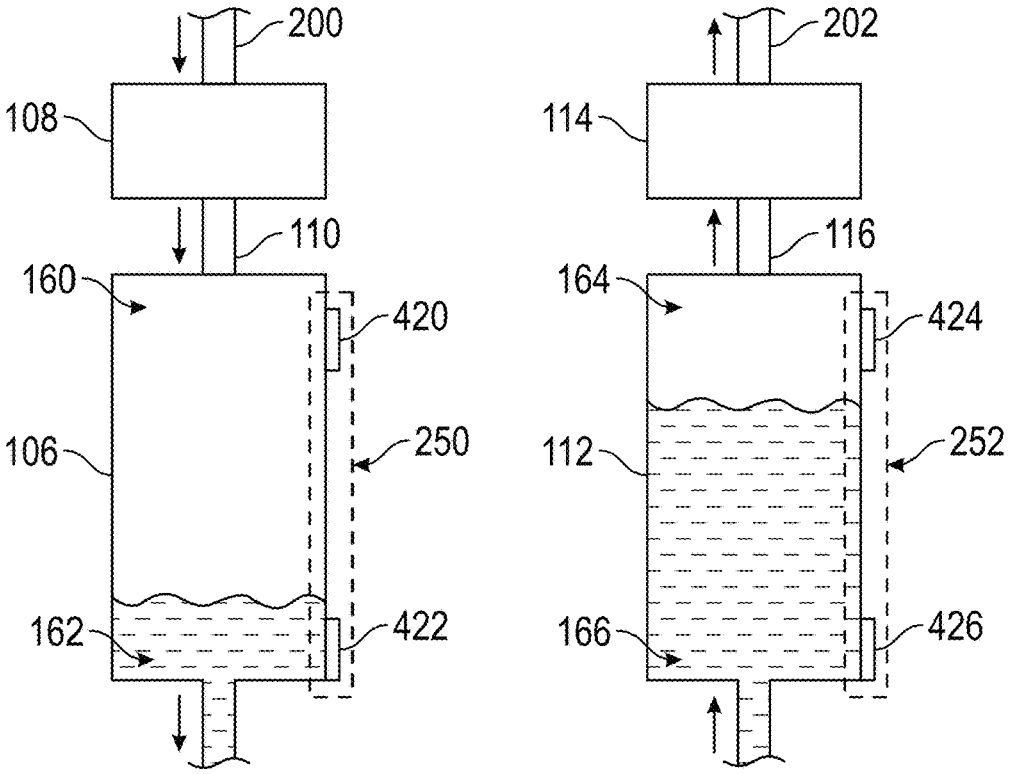

FIGS. 4B and 4C are illustrations of a method a removing debris using the pumping system 100. The first chamber 106, the second chamber 112, the first motor assembly 108, and the second motor assembly 114 can work together to remove debris. For example, as shown in FIG. 4B, the first motor assembly 108 can create negative pressure in the first chamber 106. The negative pressure can generate sufficient suction force to siphon debris through the inlet conduit 102 and separate fluid and/or smaller sized debris from the larger sized debris through the filter system 120. The fluid and/or smaller sized debris can further be pulled into the first chamber 106 via the conduit 132 in a direction indicated in FIG. 4B.

The negative pressure in the first chamber 106 can be sustained until the first chamber 106 is full or substantially full (e.g., the sensor 420 senses a level in the chamber 106 associated with a "full" level, though the sensor 420 does not need to be at the top of the chamber 106). Optionally, the negative pressure can be sustained (i.e., pull the liquid into the first chamber) until the sensor 420 detects presence of liquid. When the sensor 420 detects presence of liquid, the sensor 420 can generate and transmit an electronic signal to the controller 180 indicating the chamber 106 is "full". Upon receipt of the electronic signal from the sensor 420, the controller 180 can determine that the first chamber 106 is substantially full or full. Alternatively and/or additionally, the negative pressure in the first chamber 106 may be sustained until the second chamber 112 is empty or substantially empty (e.g., the sensor 426 senses a level in the chamber 112 associated with an "empty" level, though the sensor 426 does not need to be at the bottom of the chamber 112). Optionally, the negative pressure in the first chamber 106 can be sustained until the sensor 426 no longer detects presence of liquid. When the sensor 426 no longer detects presence of liquid, the sensor 426 can generate and transmit an electronic signal indicative of absence of liquid to the controller 180 indicating the chamber 112 is "empty". The controller 180, upon receipt of the electronic signal from the sensor 426, may determine that the second chamber 112 is substantially empty or empty.

Optionally, positive pressure may be generated in the second chamber 112 using the second motor assembly 114 simultaneously with negative pressure being generated in the first chamber 106 by the first motor assembly 108. As discussed earlier, positive pressure in the second chamber 112 can remove the liquid stored in the second chamber 112 via the conduit 136 and the valve 128. The simultaneous generation of negative pressure in the first chamber 106 and positive pressure in the second chamber 112 can allow the pumping system 100 to simultaneously siphon debris into the first chamber 106 and eject separated fluid and/or smaller sized debris from the second chamber 112. This configuration can advantageously allow continuous suction of debris into the pumping system 100 and continuous removal of separated fluid and/or smaller sized debris from the pumping system 100. In another implementation, generating negative pressure in the first chamber 106 and generating positive pressure in the second chamber 112 may not occur simultaneously.

When the controller 180 determines that the first chamber 106 is full or substantially full, the controller 180 can generate positive pressure in the first chamber 106 using the first motor assembly 108, as shown in FIG. 4C. Additionally and/or alternatively, the controller 180 can generate positive pressure in the first chamber 106 when it receives an electronic signal from the sensor 420, where the electronic signal is indicative of presence of water. Optionally, the controller 180 can generate negative pressure in the second chamber 112, as shown in FIG. 4C. The positive pressure in the first chamber 106 and the negative pressure in the second chamber 112 can be generated simultaneously or substantially simultaneously. As noted earlier, this configuration can advantageously allow continuous suction of debris into the pumping system 100 and continuous removal of separated liquid from the pumping system 100.

The positive pressure in the first chamber 106 can be sustained until the first chamber 106 is empty or substantially empty. Optionally, the positive pressure in the first chamber 106 can be maintained until the sensor 422 no longer detects presence of liquid. When the sensor 422 no longer detect presence of liquid, the sensor 422 can generate and transmit an electronic signal to the controller 180, where the signal is indicative of absence of liquid. Upon receiving the electronic signal from the sensor 422, the controller 180 can determine that the second chamber 112 is empty or substantially empty.

Optionally and/or additionally, the positive pressure in the first chamber 106 can be sustained until the second chamber 112 is full or substantially full. Optionally, the positive pressure in the first chamber 106 can be sustained until the sensor 424 of the second chamber 112 detects presence of liquid. When the sensor 424 detects presence of liquid, it can generate and transmit an electronic signal indicative of presence of liquid to the controller 180. The controller can, upon receipt of the electronic signal from the sensor 424, determine that the second chamber 112 is full or substantially full.

The liquid level sensors (for example, the sensor 420 and the sensor 424) can optionally be placed some distance away from the conduit 110, 116 to inhibit (e.g., prevent) flow of fluid and/or smaller sized debris into the conduit 110, 116 to avoid contact with the motor assemblies 108, 114, thereby advantageously avoiding damage to the motor assemblies 108, 114.

Optionally, the chambers (for example, the first chamber 106 and the second chamber 112) can include three or more level sensors. For example, the first chamber 106 can include two level sensors coupled at its bottom portion and two level sensors coupled at its top portion. The redundancy of the level sensors can further ensure correct operation of the pumping system 100 and reduce the risk of damage to various components such as the first motor assembly 108 and the second motor assembly 114.

Other Example Operations of Pumping System

Optionally, the first motor assembly 108 and the second motor assembly 114 can simultaneously generate negative pressure in the first chamber 106 and the second chamber 112, respectively. Additionally, the first motor assembly 108 and the second motor assembly 114 can simultaneously generate positive pressure in the first chamber 106 and the second chamber 112, respectively. In this regard, the fluid and/or smaller sized debris separated by the filter system 120 can simultaneously be routed to the first chamber 106 and the second chamber 112. Additionally, the debris in the first chamber 106 and the second chamber 112 once full can simultaneously be removed via the outlet conduit 104. Although this configuration may not allow continuous removal of debris from flooded area, it can provide additional suction force by having both the first motor assembly 108 and the second motor assembly 114 generate negative pressure in the first chamber 106 and the second chamber 112, respectively.

The user interface 182 and the controller 180 can allow users to decide whether to use the first chamber 106 (and the first motor assembly 108) and the second chamber 112 (and the second motor assembly 114) simultaneously or alternatingly. As discussed above, the chambers and the corresponding motor assemblies can operate in an alternating fashion such that one chamber siphons filtered fluid and/or smaller sized debris while the other chamber simultaneously ejects the siphoned fluid and/or smaller sized debris. Alternatively, the chambers and corresponding motor assemblies can operate simultaneously such that the chambers siphon debris simultaneously and eject siphoned debris simultaneously.

The pumping system 100 can include two or more chambers and corresponding motor assemblies. For example, the pumping system 100 may include four chambers and four corresponding motor assemblies that can generate negative or positive pressure in corresponding chambers.

Optionally, the pumping systems 100 can be coupled in series (e.g., in a daisy chain) to remove debris over a longer distance, or in parallel to remove a larger amount of debris in a shorter amount of time. The pumping systems 100 can communicate with other pumping systems 100 via a wired and/or wireless communication protocol. The pumping systems 100 can communicate to coordinate operation of their respective motor assemblies and chambers to remove liquid medium from flooded area more efficiently.

Optionally, the pumping system 100 may be modular such that it can be mounted on another device for improved transportability.

While certain applications of the pumping system 100 have been described, the pumping system 100 may be used for pumping and/or transporting various types of materials having one or both of fluid (gas and/or liquid) and solid between different locations.

Optionally, the pumping system 100 may be used at a dairy farm or factor in transporting different type of dairy products (for example, milk, custard, curd, cheese, butter, and the like) from one location to another. For example, the pumping system 100 can be used to transport finished products to a packaging area.

Optionally, the pumping system 100 may be used to transport or pump different types of waste (for example, organic waste, inorganic waste, hazardous waste, recyclable waste, and the like) from one location to another. In some implementations, the pumping system 100 can be used to remove animal waste (e.g., from a facility with livestock). In some implementations, the pumping system 100 can be used to remove food waste.

Optionally, the pumping system 100 can also be used as a gas feeding system, ventilation system, or purging system that may require moving different types of gases to and from different locations. In some implementations, the pumping system 100 can be used to provide ventilation for factories, hospitals, or other industrial locations that require continuous ventilation.

Optionally, the pumping system 100 may be used to transport hazardous or non-hazardous chemicals to and from different locations.

Optionally, the pumping system 100 may be used in various fire suppression applications. As discussed above, the pumping system 100 can create continuous suction and removal of liquid and/or solid. In this regard, the pumping system 100 may be used to siphon water from a water source and purge the siphoned water for fire suppression. In some implementations, the pumping system 100 may be used as portable fire suppression device for private residences. Users may place the inlet conduit 102 of the pumping system 100 in a pool, for example, and use the pumping system 100 to siphon water from the pool and pump water out for fire suppression. The pump system 100 may be especially useful in fighting fire in residential areas having houses with pools, or near lakes, lagoons, ponds or other bodies of water.

Optionally, the pumping system 100 can be used as a fire suppression unit mounted on a vehicle. The sizes of various components of the pumping system 100 may be varied to adjust the pumping system 100 for different applications requiring different volume of water pumped per second or water pressure. For example, the pumping system 100 can include larger gas or diesel-powered motors to achieve greater pump pressure (i.e., increased suction and pumping). In this regard, the pumping system 100 may be used in larger operations (for example, hazardous spill containment and larger-scale fire suppression).

Optionally, the pumping system 100 can be used in spill removal applications, such as spills on roads or highways, to remove spilled fluids (e.g., oil, gasoline, chemicals, etc.).

The examples above describe herein some non-limiting applications or uses of the pumping system 100 and are not intended to limit the scope of possible uses of the pumping system 100.

Chamber Assembly

Figure 4D:
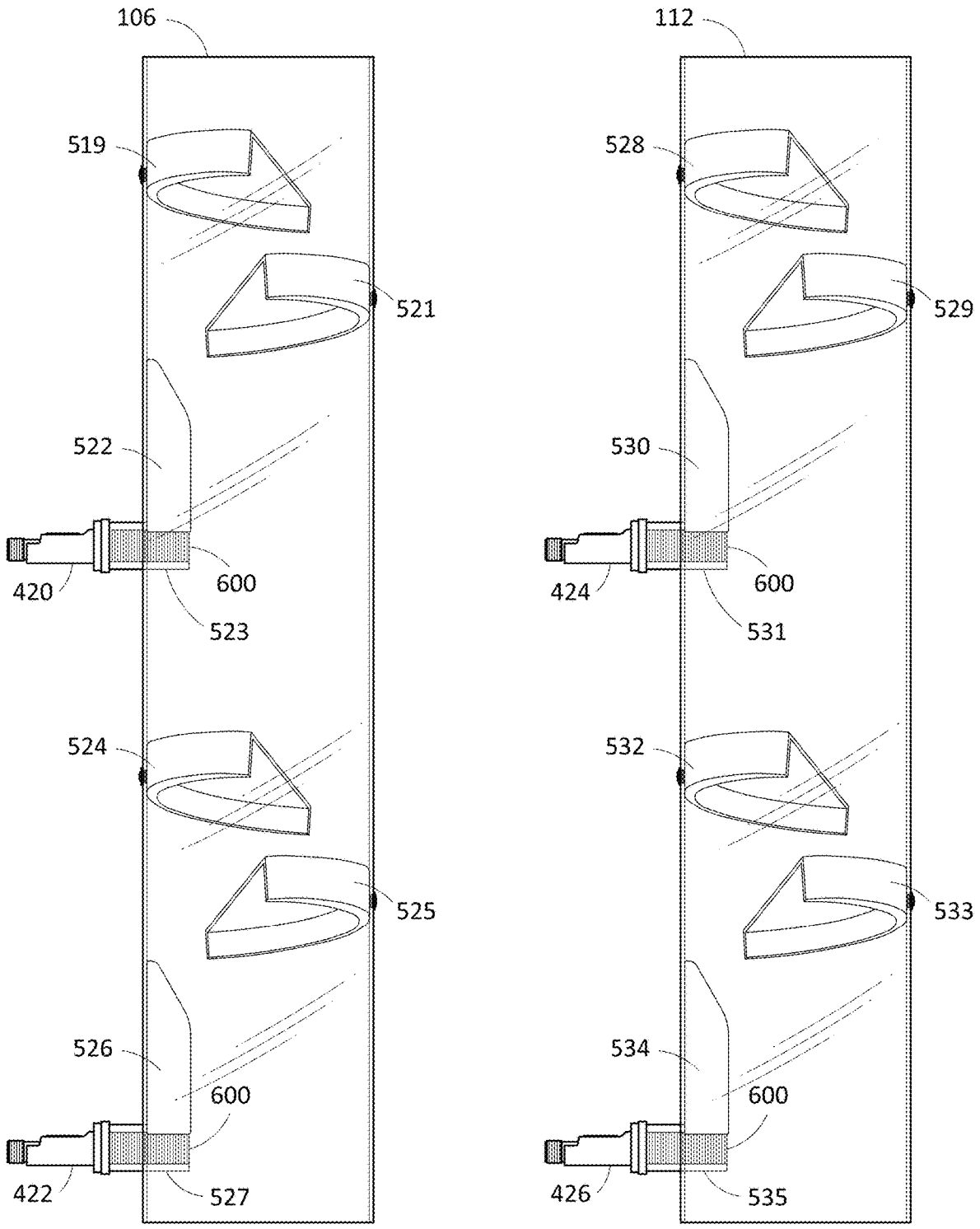
FIG. 4D is a partial perspective view of the pumping system chambers with the implementation of the angled baffles, sensor, sensor guards, and sensor sleeves.

FIG. 4D illustrates a schematic view of the first chamber 106 and the second chamber 112 of the pumping system 100 according to one implementation. The first and second chambers 106, 112 can include angled baffles 519, 521, 524, 525, 528, 529, 532, 533 to direct the flow of water, media, and air over the sensor 420, 422, 424, 426. The sensors 420, 422, 424, 426 extend inward (e.g., radially inward) into the chamber 106, 112 (e.g., the sensors 420, 422, 424, 426 do not sit flush with the inner walls of the first and second chambers 106, 112). In one example, the sensors 420, 422, 424, 426 extend inward into the first and second chambers 106, 112 by about 20-25 mm. A sensor guard 522,526,530, 534 can be placed above the sensors 420, 422, 424, 426 to inhibit (e.g., prevent) the buildup of mud and silt on the sensors 420, 422, 424, 426, as well as prevent obstruction of the sensors 420, 422, 424, 426 (e.g., by debris such as gloves, grocery bags, etc. that would otherwise get caught on top of the sensors) to inhibit (e.g., prevent) false signals by the sensors 420, 422, 424, 426.

The chamber 106, 112 as previously mentioned can each include one or more sensors within the sensor assembly 250, 252. Each sensor 420, 422, 424, 426 of the sensor assembly 250, 252 may include a sensor sleeve 523, 527, 531, 535 that inhibits (e.g., prevents) false sensing due to high conductivity of water (e.g., ocean water) that passes into the first and second chambers 106, 112 during operation of the pumping system 100 (e.g., to remove sea water and debris from a flooded area following, for example, a hurricane or other flooding event). The angles baffles 519, 521, 524, 525, 528, 529, 532, 533 direct the flow of water and media over the input sensing part (e.g., the distalmost end) of the sensor 420, 422, 424, 426.

Figure 6A:
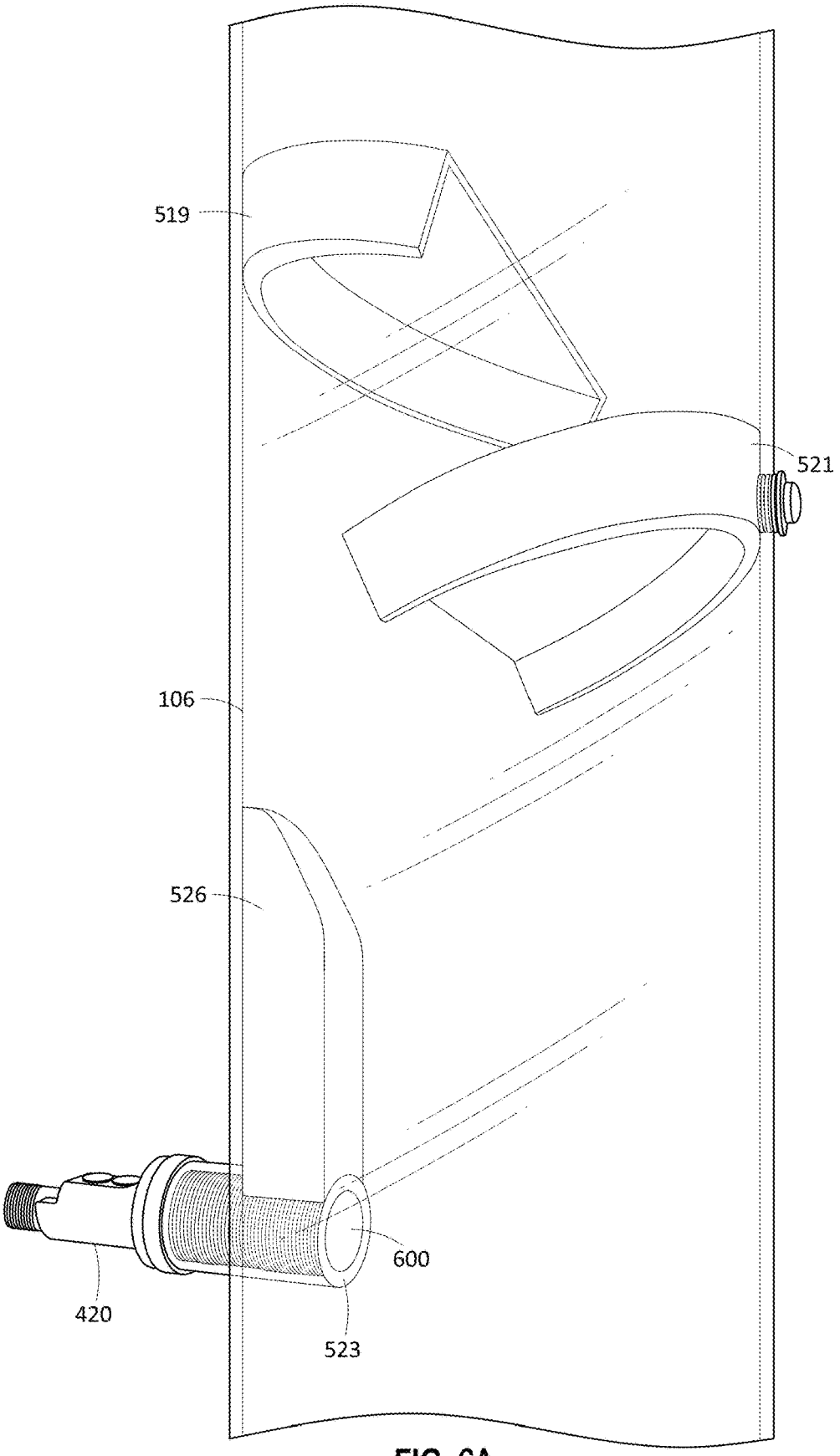
FIG. 6A is a partial perspective view of the pumping system chamber with the implementation of the angles baffles, sensor, sensor guards, and sensor sleeves.

FIG. 6A illustrates a rotated side view of the chamber assembly of the first chamber 106. As water, media, and air flow from the upper section of the first chamber 106 to the lower section the baffles 519, 521 direct the flow toward (e.g., onto) the sensing input (e.g., the distalmost end) of the sensor 420, which can advantageously clean the sensing input (e.g., the distalmost end) and remove any material obstructing the input of the sensor 420.

Figure 6B:
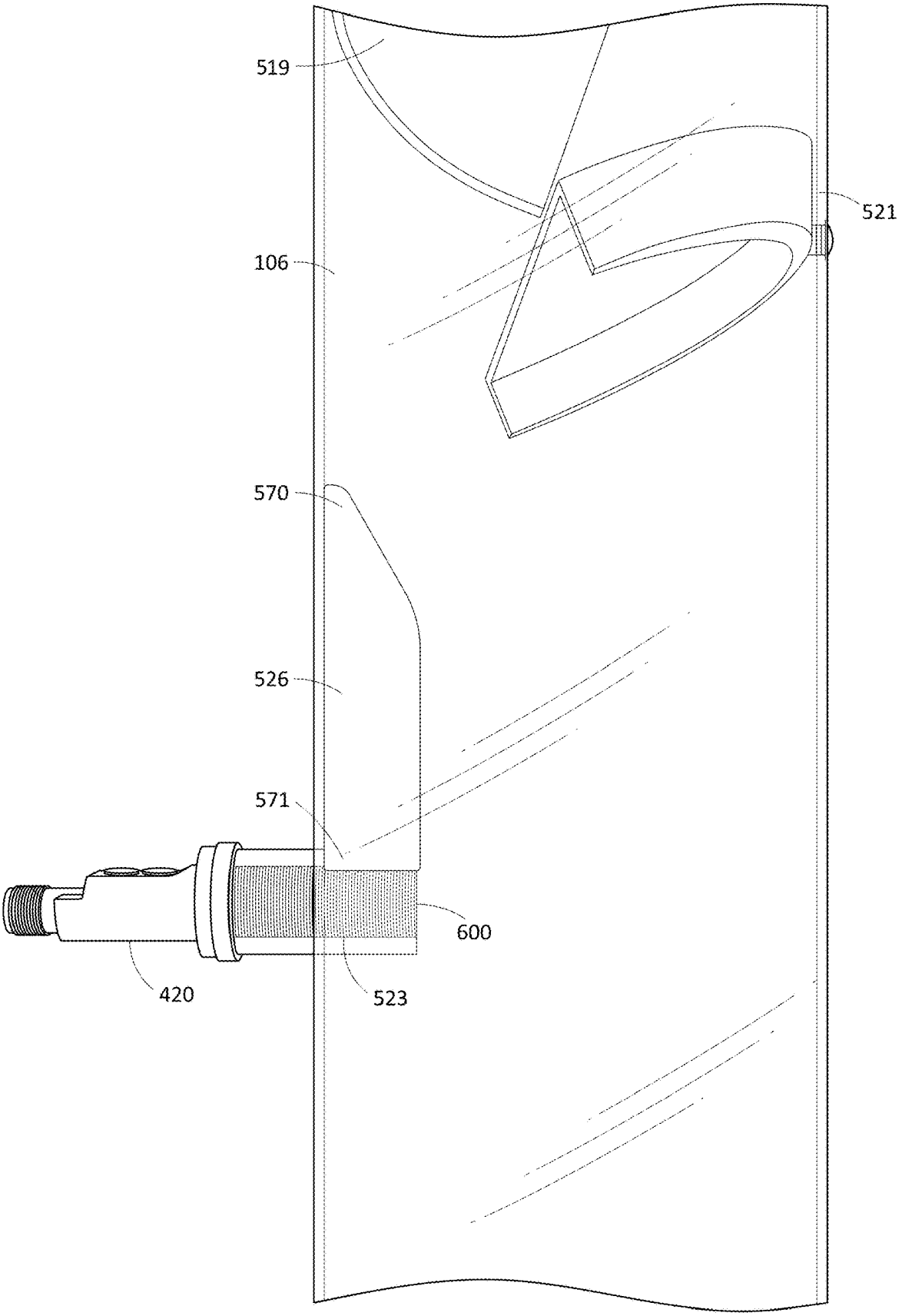
FIG. 6B is a partial side view of the pumping system chamber with the implementation of the angles baffles, sensor, sensor guard, and sensor sleeve.

FIG. 6B illustrates a side view of the chamber assembly of the first chamber 106. The sensor guard 526 has a straight lower portion 571 extending from the sensors 420 and a pointed (e.g., angled) upper portion 570 with a bias towards the inner wall of the first chamber 106. The pointed (e.g., angled) upper portion 570 allows for debris and larger obstructions to slide off the sensor guard 526 and away from the sensor 420. The base of the sensor guard covers the entirety of the sensor body (e.g., an entire length of the sensor 420) to inhibit (e.g., prevent) any loose obstructions (e.g., bags, etc.) wrapping around the sensor.

Figure 6C:
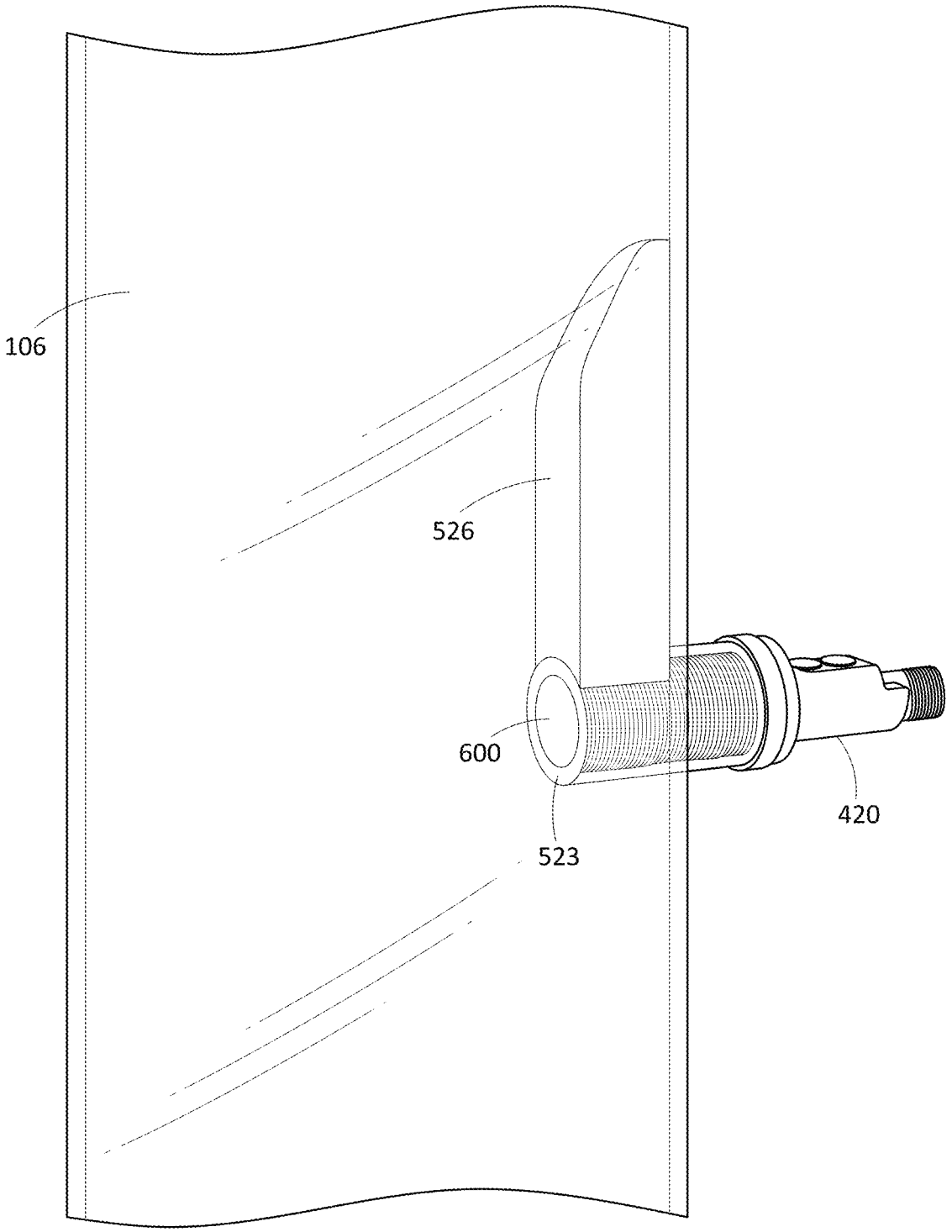
FIG. 6C is a partial perspective view of the pumping system chamber with the implementation of the sensor, sensor guard, and sensor sleeve.

FIG. 6C illustrates a rotated partial side view of the sensor 420 with the sensor guard 526 mounted on the inner wall of the first chamber 106 on top of the sensor 420. The sensor sleeve 523 surrounds the sensor body while exposing the sensor input 600 (e.g., the distalmost end of the sensor 420). The utilization of the sensor sleeve 523 advantageously inhibits (e.g., prevents) mutual interference when more than 1 sensor is used in a sensor assembly. For example, when the first chamber 106 of FIG. 4D and second chamber 112 of FIG. 4D is advantageously utilizing sensors 420, 422 and 424, 426 simultaneously while syphoning salt water from a flooded area, the higher salt levels increase conductivity of the water and media, which can reduce the effectiveness of the sensors 420,422 and 424,426 if the sensors are not covered with such sensor sleeves 523 (see also sensor sleeves 527, 531, 535 in FIG. 4D). The sensor sleeve 523 advantageously inhibits (e.g., prevents) sensor malfunctioning while exposed to salt water (e.g., ocean water).

Buoy Assembly

Figure 5A:
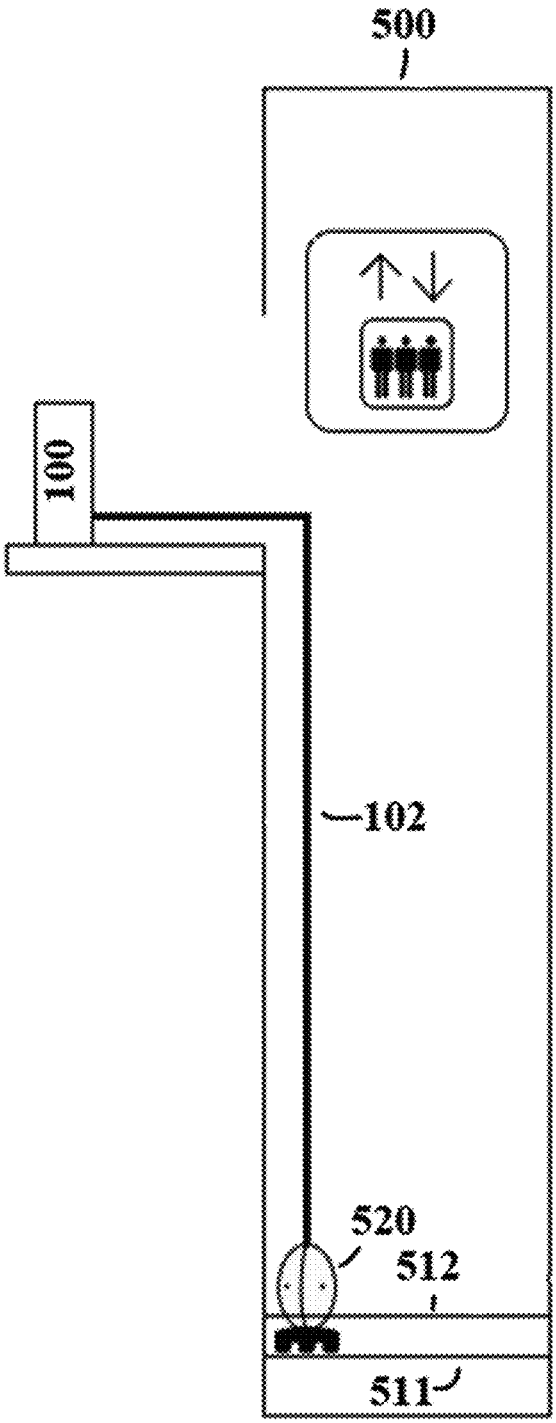
FIG. 5A illustrates an example of the utilization of the buoy, deployed in a flooded elevator shaft.
Figure 5B:
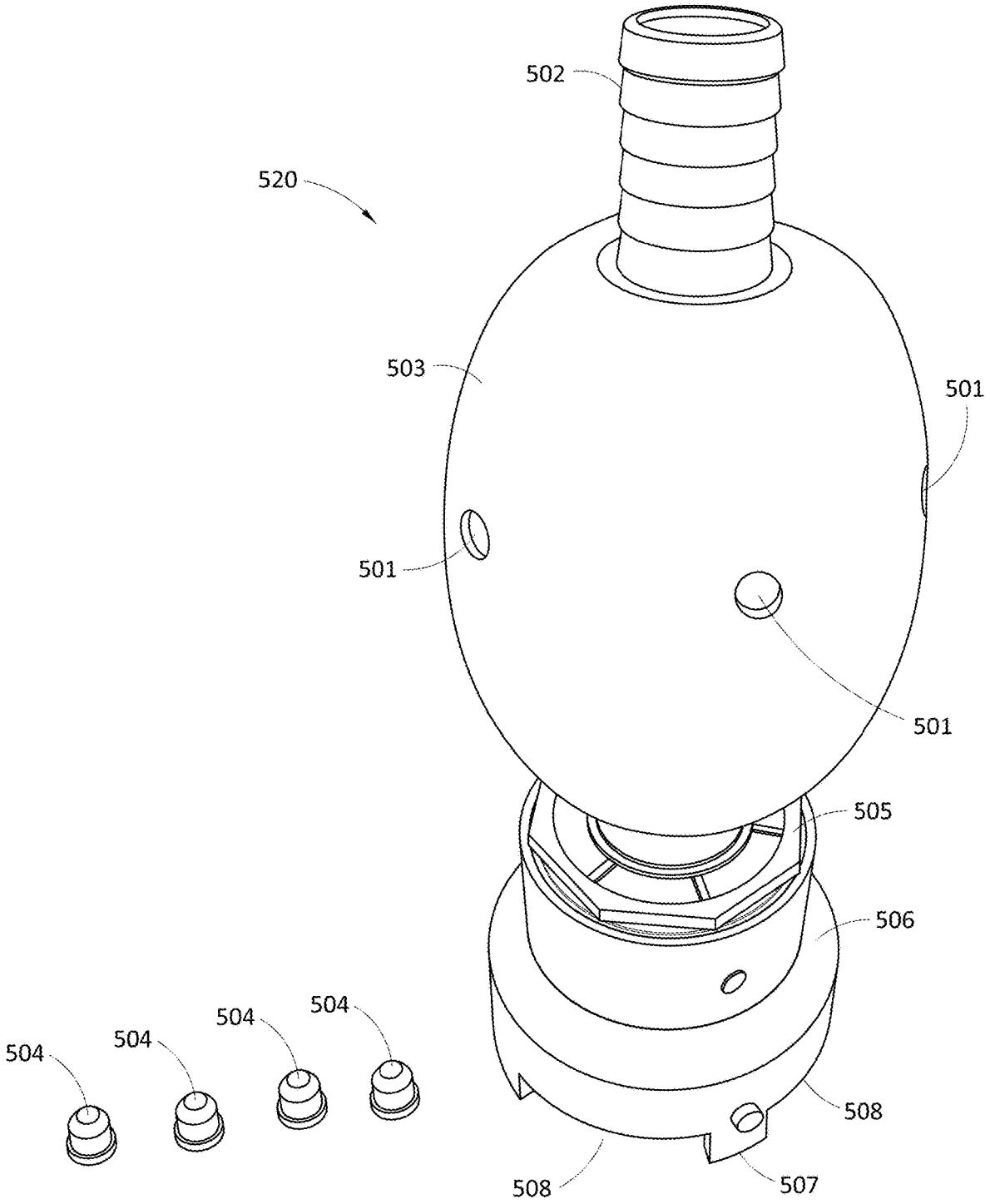
FIG. 5B a perspective view of the buoy with the buoy aeration ports unplugged for maximum air flow.
Figure 5C:
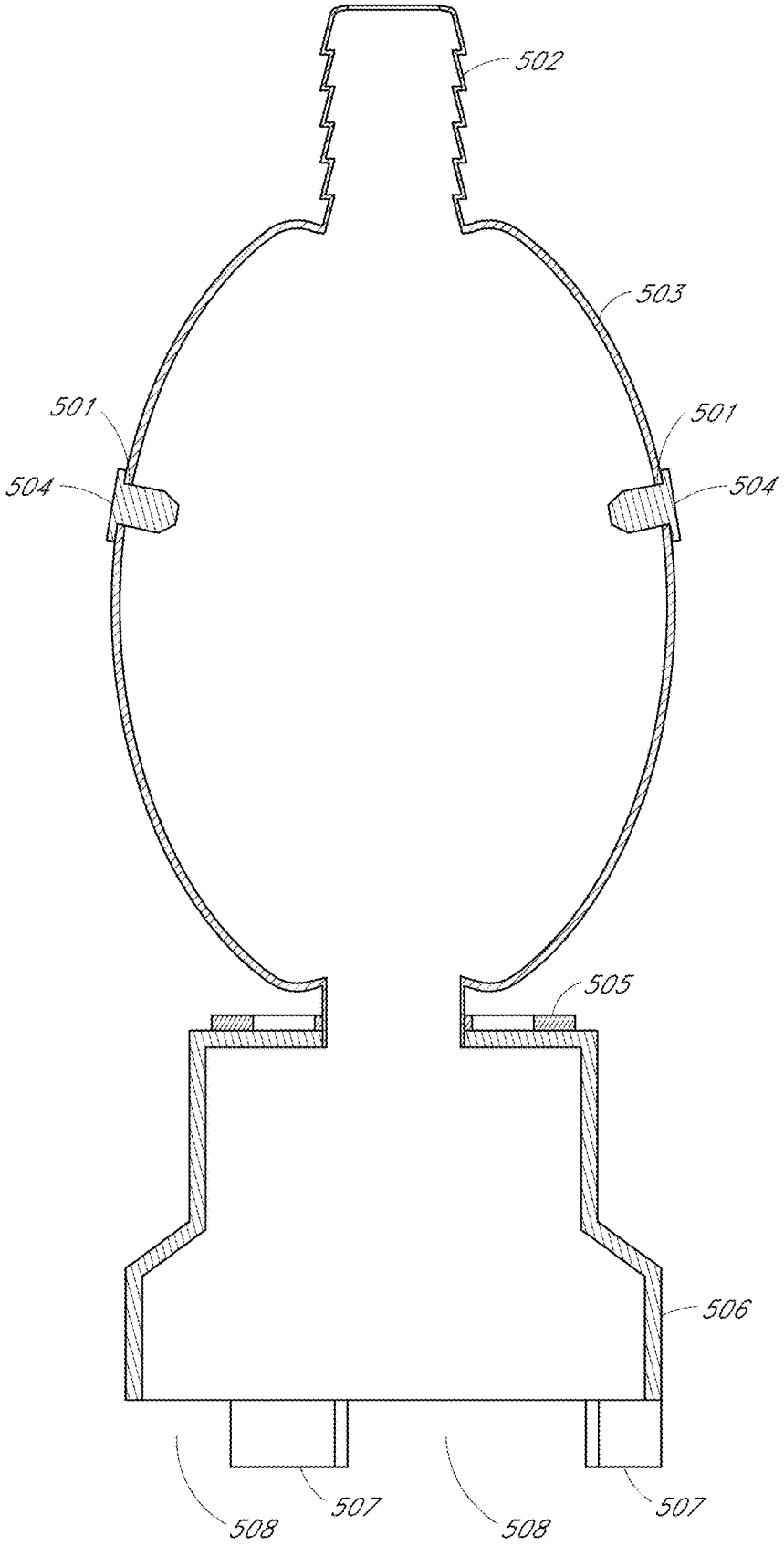
FIG. 5C a side view of the buoy, proximal tube, threaded adapter, and adapter socket.
Figure 5D:
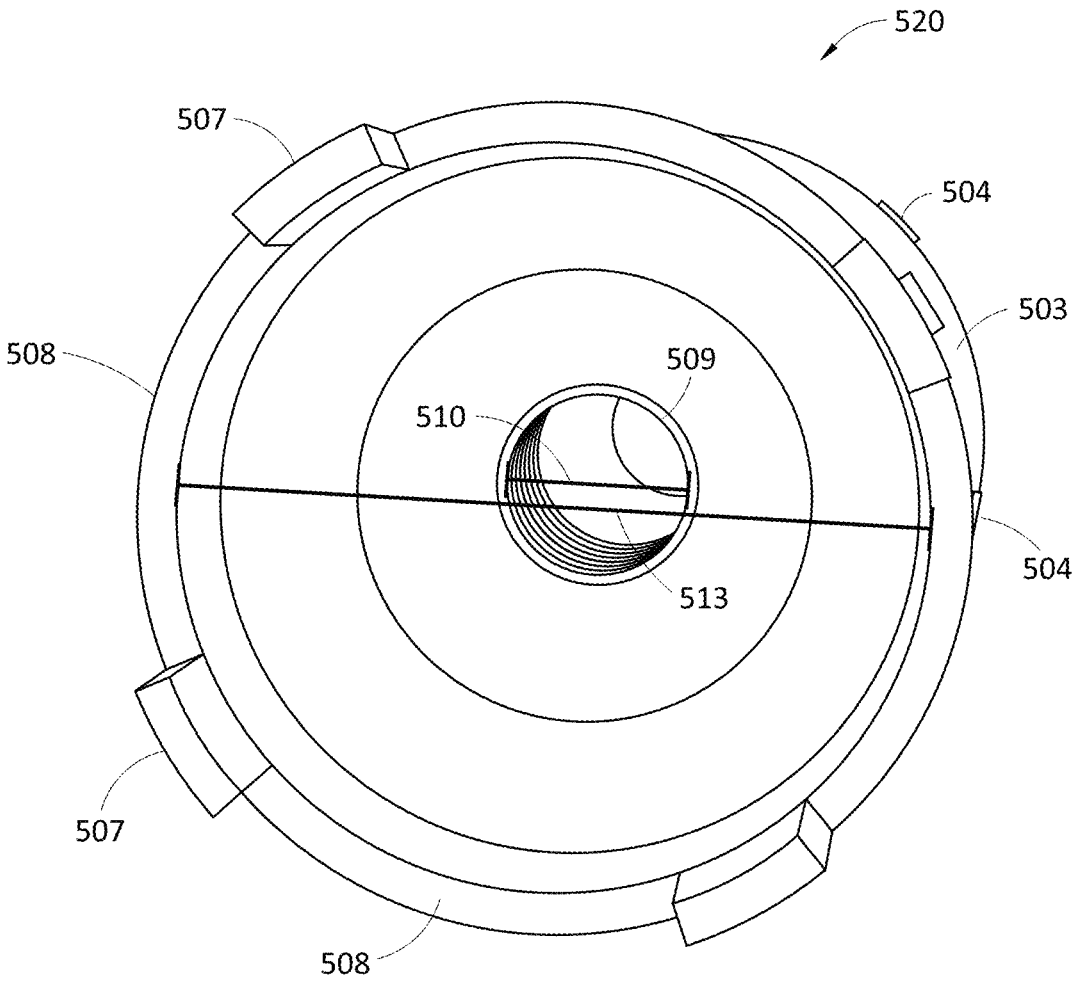
FIG. 5D a bottom view of the buoy, showing an example of the inlet diameter size.

Referring to FIG. 5B-5D, an example buoy assembly 520 is described for use with a pumping system, such as the pumping system 100. In FIG. 5A, the buoy assembly 520 is attached to the pumping system 100 with a inlet conduit 102 (e.g., tube, hose). In one implementation, the buoy assembly 520 includes a plurality of buoy aeration ports 501 to optimize flow of media (e.g., debris such as dirt, mud, rocks, water, etc.) and air through the inlet conduit 102 over a considerable vertical distance (e.g., 10 feet, 15 feet, 20 feet, 25 feet, 30 feet). The buoy assembly 520 advantageously introduces or facilitates lift within the inlet conduit 102 to facilitate the lifting and removal of heavy debris by the pumping system 100 (e.g., from a flooded shaft, such as an elevator shaft).

FIG. 5A illustrates an example of a possible deployment of the buoy assembly 520. The illustration depicts a flooded elevator shaft 500 where the base level of the elevator shaft 500 is substantially lower than the base level (e.g., ground level) on which the pumping system 100 sits upon. The elevator shaft 500 is depicted with a silt/debris level 511 on which the buoy assembly 520 may stand on. The elevator shaft 500 is depicted with a liquid level 512 in which the buoy assembly 520 may float on. In one example, the liquid level 512 may be higher than the silt/debris level 511 so that during initial operation the buoy assembly 520 floats on the liquid level 512 without touching the silt/debris level 511 and the pumping system 100 may initially only remove liquid from the shaft 500 until the bottom of the buoy assembly 520 reaches the silt/debris level 511.

FIG. 5B illustrates the adaptor socket feet 507 and vents 508. The adaptor socket feet 507 may allow the buoy assembly 520 to stand, for example on silt/debris, where the liquid level 512 of FIG. 5A is not high enough for the buoy assembly 520 to float upon it. In such event, the vents 508 prevent the buoy inlet 509 (see FIG. 5D) from being obstructed and allow flow of debris via the vents 508 into the buoy inlet 509 (e.g., from outside the buoy assembly 520). The buoy assembly 520 has a proximal tube 502 via which the buoy assembly 520 can couple to an end of the inlet conduit 102, the opposite end of the inlet conduit 102 being coupled to the pumping system 100. The buoy assembly 520 has a buoy 503 attached to the proximal tube 502. In one example, the buoy 503 can have a height of 6.5 inches, a centerline outer diameter (e.g., maximum outer diameter) of 5.5 inches, and end openings having a diameter of 1.25 inches. In one example, the buoy assembly 520 can have a height of 15 inches with an outlet diameter (at the proximal tube 502) of 1 inch and an inlet diameter 510 of 5 inches.

The buoy 503 can be hollow. In one example, the buoy 503 can be made of a buoyant material, such as a foam material (e.g., dense EVA foam chemical resistant material). The buoy 503 can be buoyant so that it can float on liquid. In one example, the buoy 503 can have a buoyant force of 4.5 lbf. In the illustrated embodiment, the buoy 503 has a generally ovoid shape. In another implementation, the buoy 503 can have a generally spherical shape. The buoy 503 provides the buoy assembly 520 with a buoyant force that allows the buoy assembly 520 to float on the liquid level 512. In the illustrated implementation, the buoy 503 includes 4 buoy aeration ports 501, each of which allows airflow from outside the buoy 503 to inside the buoy 503 when the port is open (e.g., not covered by a plug). However, in other implementations, the buoy 503 can have fewer (e.g., 3, 2, 1) or more (e.g., 5, 6, 7, etc.) aeration ports 501. In one example, the aeration ports 501 can have a diameter of 0.5 inches. In one implementation, the aeration ports 501 can have the same diameter. In other implementations, the aeration ports 501 can have varying diameters. The buoy aeration ports 501 can be selectively closed by corresponding plugs 504. In the illustrated embodiment, the aeration ports 501 are disposed above a midline (e.g., closer to an upper end than a lower end) of the buoy 503, which advantageously inhibits (e.g., prevents) liquid from passing through the aeration ports 501 into the buoy 503. In another implementation, the aeration ports 501 can be disposed at the midline (e.g., half-way between an upper and a lower end) of the buoy 503.

In operation, one or more of the buoy aeration ports 501 can be unplugged and a remaining number of the buoy aeration ports 501 can be closed with the plugs 504, depending on the amount of aeration or lift needed for a particular operation (e.g., depending on the depth of the shaft 500 in which the buoy assembly 520 is introduced, for example, to introduce the optimal amount of lift that will overcome the vertical pumping distance). As the pumping system 100 operates to pump liquid and/or debris from the shaft 500, air is advantageously suctioned into the buoy 503 via the aeration ports 501 and travels up the inlet conduit 102. Said suctioned air flowing up the inlet conduit 102 advantageously aids in lifting the debris through the inlet conduit 102 up toward the pumping system 100.

An adapter 505 can be attached to an opposite end of the buoy 503 from the proximal tube 502. The adapter 505 can in one implementation be removably coupled (e.g., threadably coupled) to the buoy 503. The buoy assembly 520 can also include an adapter socket 506. In one implementation, the adapter socket 506 can be removably coupled (e.g., threadably coupled) the adapter 505, allowing for a quick attachment of a threaded adapter socket 506 for quick replacement when needed. In another implementation, the adapter 505 and the adapter socket 506 can be a single (e.g., monolithic, seamless) piece. The adapter socket 506 has feet 507 and defines the vents 508, as discussed above.

FIG. 5D illustrates the tapering diameter of the adapter socket 506. The adaptor socket diameter 513 is larger than the buoy inlet diameter 510 lowering the pressure and increasing the rate of speed of which the water and debris will flow into the buoy assembly 520. This allows for debris with greater mass to be lifted to the heights of which would be normally difficult for an ordinary pumping system.

Figure 5E:
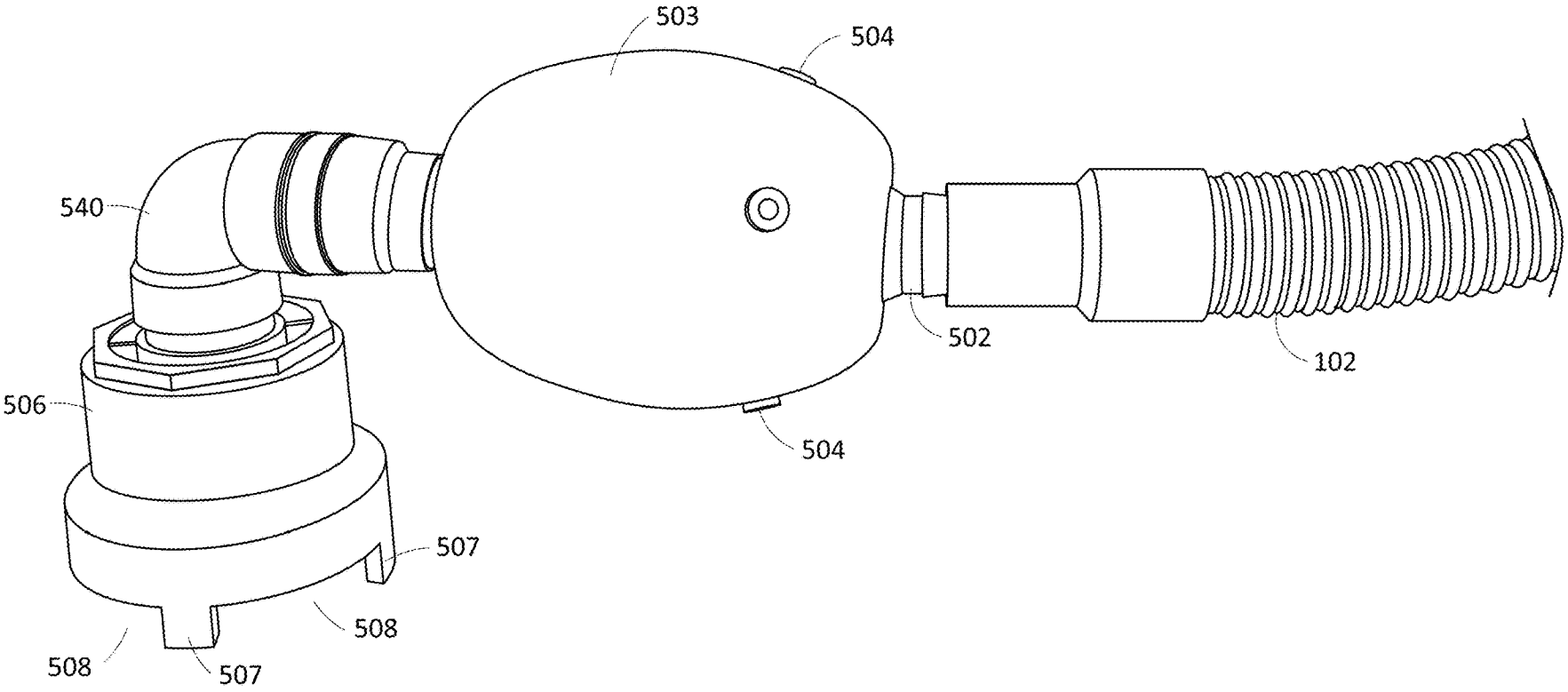
FIG. 5E a side view of the conduit and elbow conduit coupled to the buoy.
Figure 5F:
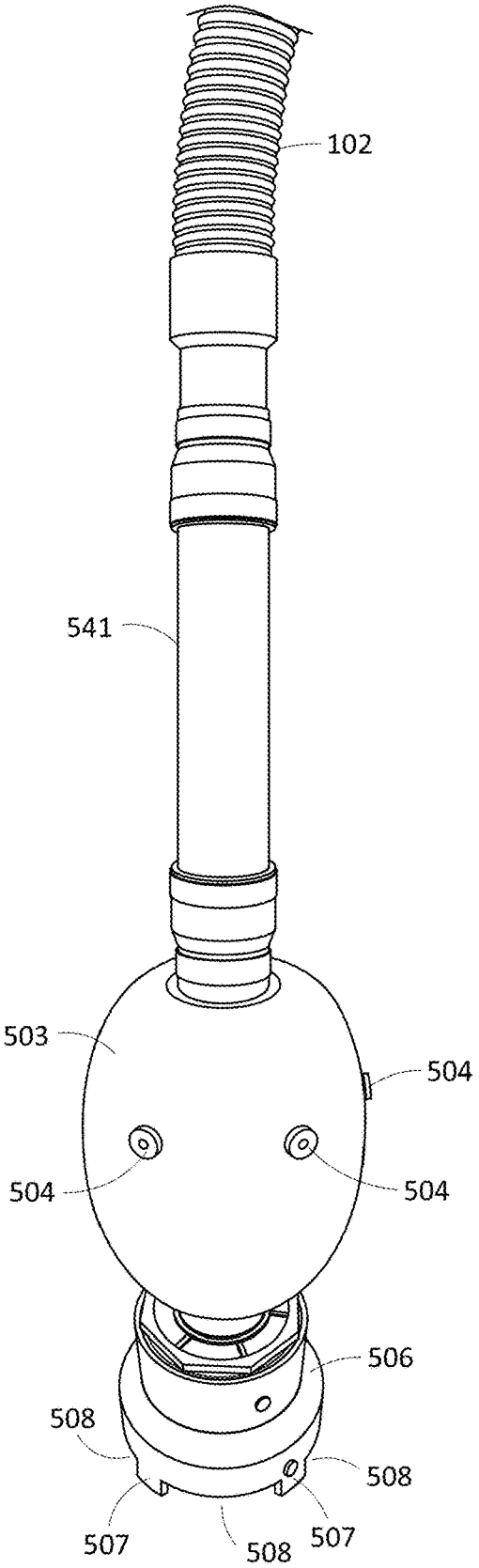
FIG. 5F a front view of the conduit and distal conduit (e.g., rigid conduit) couple to the buoy.

FIG. 5E and FIG. 5F illustrates other configurations for the buoy assembly 520 of FIG. 5B. The elbow conduit 540 of FIG. 5E and the distal conduit 541 of FIG. 5F provide alternative methods for optimizing the flow of water and media through the inlet conduit 102 fluidly coupled to the pumping system 100. The buoy assembly 520 of FIG. 5B coupled to the elbow conduit 540 as presented in FIG. 5E provides an advantageous orientation and increases stability while deployed in a flooded area. The orientation utilizes the aeration ports 501 of FIG. 5B selectively opened optimizing airflow to facilitate lift of liquid and media while suction force is applied to the inlet conduit 102. The buoy assembly 520 of FIG. 5B coupled to the distal conduit 541 as presented in FIG. 5F provides an increase in rigidity while coupled to the inlet conduit 102. The increase in rigidity is advantageous during use when the inlet conduit 102 is longer in length than is required in the event of a deployment. The extra length of the inlet conduit 102 floating on the surface of water and media can create undesirable tilt in the buoy assembly 520 of FIG. 5B when a suction force is applied to the inlet conduit 102 which may make it more difficult to suction water and media when a suction force is applied. However, the increased rigidity provided by the distal conduit 541 inhibits such tilting, thereby optimizing the flow of water and media. The distal conduit 541 can be a rigid or semirigid conduit (e.g., made of PVC or other polymer material). The distal conduit 541 can be more rigid (e.g., have greater stiffness) than the inlet conduit 102. The inlet conduit 102 an be a flexible conduit (e.g., a hose that can be rolled for storage and extended during use).

Figure 5G:
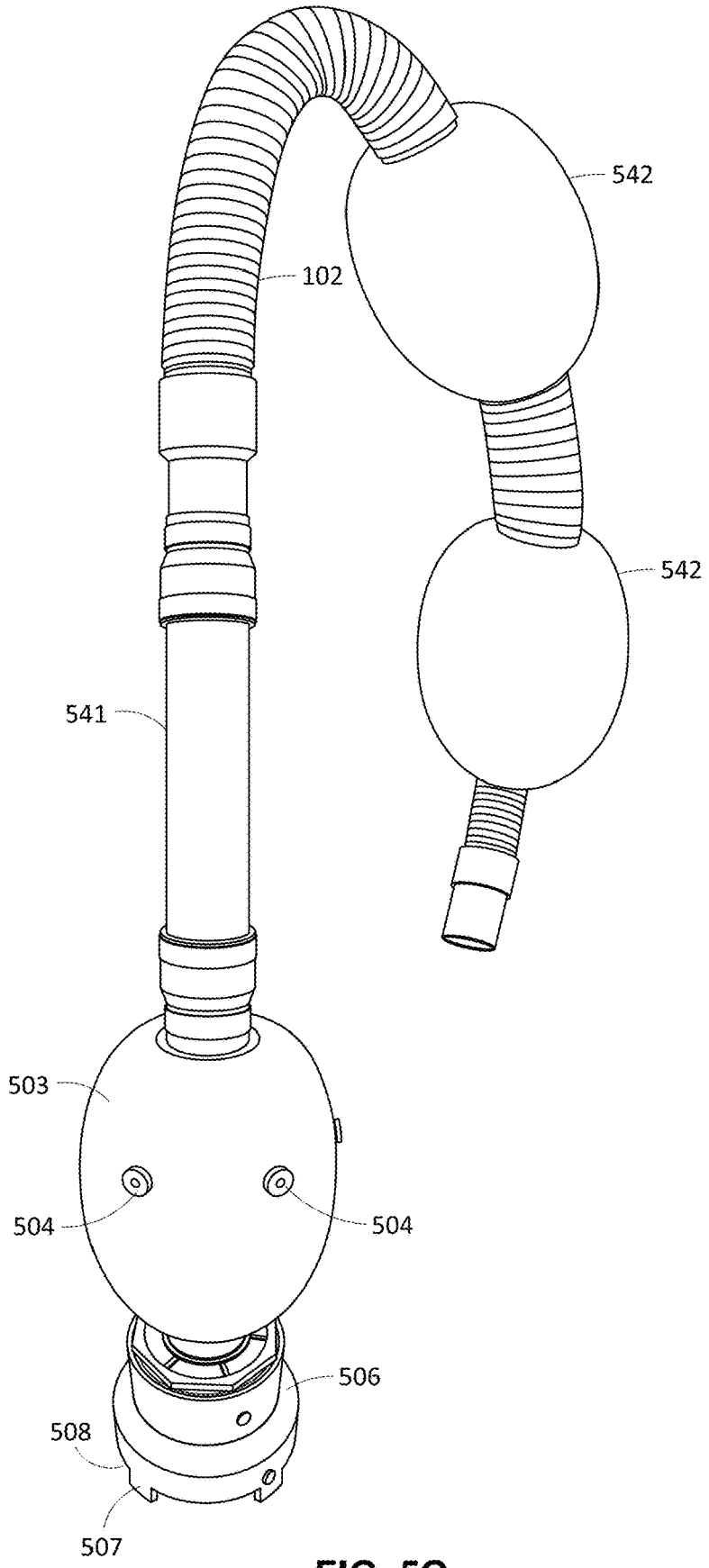
FIG. 5G a front view of the conduit with a pair of buoys attached to the conduit, and a distal conduit (e.g., rigid conduit) coupled to the buoy.

FIG. 5G illustrates an inlet conduit 102 with removable buoys 542 coaxially coupled (spaced laterally apart), for example every 2 ft, coupled to a distal conduit 541. The removable buoy 542 provides, in one implementation, at least 5 lbs. of buoyant force. However, the design can be modified to increase buoyant force (e.g., by providing more buoys 542 attached to the inlet conduit 102). The removable buoy(s) 542 attached to the inlet conduit 102 provides additional buoyant force to the extra length of the inlet conduit 102 deployed, preventing the inlet conduit 102 from fully submerging under the water and media the inlet conduit 102 is deployed in. The buoyant force of the removable buoy(s) 542 advantageously keeps the inlet conduit 102 afloat and the buoy assembly 520 in an ideal predetermined position during the siphoning process. There may be a single removable buoy 542 used with the deployment of the inlet conduit 102 in a flooded area or as many required to optimize operation of the buoy assembly 520 of FIG. 5B. In other implementations, the buoy(s) 542 can be permanently fixed (e.g. adhered) to the inlet conduit 102. In another implementation, the buoy(s) 542 can be coupled alongside (e.g., not coaxial, along a parallel axis to) the conduit 102 (e.g., with clamps or other coupling mechanisms).

Terminology

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations.

Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

The invention claimed is:

1. A pumping system comprising:

an inlet conduit;

a chamber assembly in fluid communication with the inlet conduit; and a buoy assembly removably coupleable to an end of the inlet conduit and configured to be deployed in a flooded shaft for removal of debris and liquid therefrom, the buoy assembly comprising a buoy configured to float on a liquid surface and having one or more aeration ports selectively opened to allow airflow therethrough from outside the buoy to inside the buoy to facilitate lifting of liquid and debris along the inlet conduit toward the chamber assembly; and one or more baffles in the chamber assembly and one or more sensors that extend into a chamber of the chamber assembly, the baffles configured to direct liquid flowing through the chamber assembly toward the one or more sensors.

2. The pumping system of claim 1, wherein the one or more aeration ports are disposed circumferentially about the buoy at a location closer to a proximal end of the buoy than a distal end of the buoy.

3. The pumping system of claim 1, wherein the one or more aeration ports are selectively opened by removing a plug therefrom.

4. The pumping system of claim 1, wherein the buoy assembly further comprises a proximal tube coupled to a proximal end of the buoy and configured to couple to the end of the inlet conduit, and comprises an adapter socket operatively coupled to a distal end of the buoy, the adapter socket having a plurality of feet spaced from each other to define one or more vents therebetween via which debris and liquid can pass into a buoy inlet from outside the buoy assembly.

5. The pumping system of claim 4, further comprising an adapter coupleable to the distal end of the buoy and to the adapter socket.

6. The pumping system of claim 4, wherein the adapter socket has a larger diameter than a diameter of the buoy inlet.

7. The pumping system of claim 6, wherein a surface of the adapter socket is tapered to facilitate flow of liquid and debris toward the buoy inlet.

8. The pumping system of claim 1, further comprising one or more buoys removably coupled to the inlet conduit.

9. The pumping system of claim 1, further comprising a distal conduit disposed between the inlet conduit and the buoy assembly, the distal conduit being more rigid than the inlet conduit.

10. The pumping system of claim 4, further comprising an elbow conduit between the buoy and the adapter socket.

11. The pumping system of claim 1, wherein each of the one or more sensors is covered by a sleeve to expose only a sensor input of the one or more sensors, and wherein each of the one or more sensors has a sensor guard disposed above the sensor to inhibit debris collecting on the sensor.

12. A pumping system comprising:

a conduit;

a pump coupleable to one end of the conduit and operable to apply a suction force to the conduit;

a chamber assembly in fluid communication with the conduit and the pump and disposed between the conduit and the pump; and a buoy assembly removably coupleable to an opposite end of the conduit, the buoy assembly comprising a buoy configured to float on a liquid surface and having one or more aeration ports selectively opened to allow airflow therethrough from outside the buoy to inside the buoy to facilitate lifting of liquid and debris along the conduit toward the pump; and one or more baffles in the chamber assembly and one or more sensors that extend into a chamber of the chamber assembly, the baffles configured to direct liquid flowing through the chamber assembly toward the one or more sensors.

13. The pumping system of claim 12, wherein the one or more aeration ports are disposed circumferentially about the buoy at a location closer to a proximal end of the buoy than a distal end of the buoy.

14. The pumping system of claim 12, wherein the one or more aeration ports are selectively opened by removing a plug therefrom.

15. The pumping system of claim 12, wherein the buoy assembly further comprises a proximal tube coupled to a proximal end of the buoy and configured to couple to the end of the conduit, and comprises an adapter socket operatively coupled to a distal end of the buoy, the adapter socket having a plurality of feet spaced from each other to define one or more vents therebetween via which debris and liquid can pass into a buoy inlet from outside the buoy assembly.

16. The pumping system of claim 15, further comprising an adapter coupleable to the distal end of the buoy and to the adapter socket.

17. The pumping system of claim 15, wherein the adapter socket has a larger diameter than a diameter of the buoy inlet.

18. The pumping system of claim 17, wherein a surface of the adapter socket is tapered to facilitate flow of liquid and debris toward the buoy inlet.

* * * * *